US007722504B2

(12) United States Patent
Younger

(10) Patent No.: US 7,722,504 B2
(45) Date of Patent: May 25, 2010

(54) METHOD FOR MEASURING PHYSICAL FITNESS AND CREATING ATHLETIC TRAINING REGIMENS FOR PARTICULAR SPORTS

(76) Inventor: J. Kevin Younger, 1433 Catalpa Ct., Fort Collins, CO (US) 80521

( * ) Notice: Subject to any disclaimer, the term of this patent is extended or adjusted under 35 U.S.C. 154(b) by 389 days.

(21) Appl. No.: 11/903,526

(22) Filed: Sep. 19, 2007

(65) Prior Publication Data

US 2009/0062627 A1 Mar. 5, 2009

Related U.S. Application Data

(60) Provisional application No. 60/969,893, filed on Sep. 4, 2007.

(51) Int. Cl.
*A63B 71/00* (2006.01)

(52) U.S. Cl. ..... 482/9; 482/1; 600/300

(58) Field of Classification Search ..... 482/1–9, 482/900–902; 600/300, 301, 306, 483; 607/2, 607/48; 601/23; 73/379.01–379.03
See application file for complete search history.

(56) References Cited

U.S. PATENT DOCUMENTS 6,432,063 B1 * 8/2002 Marcus ..... 600/554
6,832,987 B2 * 12/2004 David et al. ..... 600/300
7,610,096 B2 * 10/2009 McDonald, III ..... 607/48

* cited by examiner

*Primary Examiner*—Glenn Richman
(74) *Attorney, Agent, or Firm*—James R. Young; Cochran Freund & Young LLC

(57) ABSTRACT

Disclosed is a method for creating a fitness training program based on performing neuromuscular and muscular performance tests on an individual, analyzing the results of the neuromuscular and muscular performance tests, and creating the fitness training program based on the analysis of the neuromuscular and muscular performance test results. The equipment used to perform the neuromuscular and muscular performance tests may be equipment designed for rehabilitation physical therapy used for recovery from injuries and surgical procedures that permits general neuromuscular and muscular performance testing and testing of the difference in muscle performance between a right side and a left side of the body of the individual. The individual is tested to create a fitness training program to increase neuromuscular and muscular performance, not for purposes of injury and/or surgery rehabilitation. The individual tested may be a healthy individual. The method is particularly well suited for an athlete that desires to increase performance in a particular sport. The test equipment should objectively, quantitatively, and accurately measure the general neuromuscular and muscular performance and the difference in muscle performance between the right side and left side of the body. Neuromuscular and muscular performance tests may include a variety of exercise movements with each movement tested for isometric, coordination, proprioceptive, endurance capacity, and strength capacity response. The fitness training regimen is created for the individual based on the analysis of the neuromuscular and muscular performance test results.

4 Claims, 33 Drawing Sheets

102 A) 5 SECOND ISOMETRIC TEST
- +MAX FORCE 114
- +AVERAGE FORCE 116

104 B) 10 SECOND ISOMETRIC TEST
- +MAX FORCE 118
- +AVERAGE FORCE 120

106 C) COORDINATION TEST
- +CONCENTRIC: % OF CORRECT POSITION 122
- +ECCENTRIC: % OF CORRECT POSITION 124

108 D) PROPRIOCEPTION TEST
- +DEVIATION FROM THE CORRECT POSITION 126

110 E) ENDURANCE CAPACITY TEST
- +CONCENTRIC 128
  - -PEAK FORCE 130
  - -MAX SPEED 132
  - -TOTAL WORK 134
- +ECCENTRIC 136
  - -PEAK FORCE 138
  - -MAX SPEED 140
  - -TOTAL WORK 142

112 F) STRENGTH CAPACITY TEST
- +CONCENTRIC 144
  - -PEAK FORCE 146
  - -AVERAGE WATTS 148
- +ECCENTRIC 150
  - -PEAK FORCE 152
  - -AVERAGE WATTS 154

100 LOWER EXTREMITY TESTING WITH MONITORED REHAB SYSTEM (MRS) EQUIPMENT

FIG. 1

206 A) COORDINATION TEST
- +CONCENTRIC: % OF CORRECT POSITION 222
- +ECCENTRIC: % OF CORRECT POSITION 224

208 B) PROPRIOCEPTION TEST
- +DEVIATION FROM THE CORRECT POSITION 226

210 C) ENDURANCE CAPACITY TEST
- +CONCENTRIC 228
  - -PEAK FORCE 230
  - -MAX SPEED 232
  - -TOTAL WORK 234
- +ECCENTRIC 236
  - -PEAK FORCE 238
  - -MAX SPEED 240
  - -TOTAL WORK 242

212 D) STRENGTH CAPACITY TEST
- +CONCENTRIC 244
  - -PEAK FORCE 246
  - -AVERAGE WATTS 248
- +ECCENTRIC 250
  - -PEAK FORCE 252
  - -AVERAGE WATTS 254

200 UPPER EXTREMITY TESTING WITH MONITORED REHAB SYSTEM (MRS) EQUIPMENT

FIG. 2

302 1) SQUAT (LOWER EXTREMITY)

304 2) SIDE LYING GLUT (LOWER EXTREMITY)

306 3) LATISSIMUS DORSI (UPPER EXTREMITY)

308 4) CHEST PRESS (UPPER EXTREMITY)

310 5) ROW (UPPER EXTREMITY)

312 6) LIFT (UPPER EXTREMITY)

314 7) CHOP (UPPER EXTREMITY)

300 POTENTIAL EXERCISE MOVEMENTS FOR USE WITH MRS EQUIPMENT TESTING

FIG. 3

402 1) DETERMINE AREAS OF DEFICITS: ANALYSIS OF THE FUNCTIONAL MOVEMENT SCREEN AND THE MRS TESTS 404 2) COMPARE TO THE SPORTING EVENT REQUIREMENTS 406 3) MRS IS REVIEWED AND ANYTHING OUTSIDE OF 10% DEFICIT ON THE MRS INDICATES CORRECTIVE EXERCISES ARE GIVEN IN THE FITNESS TRAINING REGIMEN 408 4) FUNCTIONAL MOVEMENT SCREEN IS REVIEWED TO DETERMINE MOBILITY AND STABILITY 410 5) FITNESS TRAINING REGIMEN IS DESIGNED IN ORDER TO GIVE THE ATHLETE/SUBJECT A BALANCED BODY 412 6) RETEST OCCURS AT 4, 6, 8, OR 12 WEEKS DEPENDING ON THE SPORT AND THE AMOUNT OF TIME TRAINER/COACH HAS WITH ATHLETE/SUBJECT 414 7) INCREASE FITNESS TRAINING REGIMEN AS INDICATED BY RETESTS AND ATHLETE/SUBJECT PROGRESS

400 DECISION CRITERIA FOR CREATING A FITNESS TRAINING REGIMEN FOR AN ATHLETE/SUBJECT

FIG. 4

502 A) BICYCLING
+SQUAT
+LATISSIMUS DORSI

504 B) BASEBALL
+SQUAT
+SIDE LYING GLUT
+LIFT & CHOP

506 C) FOOTBALL
+SQUAT
+SIDE LYING GLUT
+CHEST PRESS & ROW

508 D) SOCCER
+SQUAT
+SIDE LYING GLUT
+CHEST PRESS & ROW
+LATISSIMUS DORSI

510 E) ADDITIONAL SPORTS
+HOCKEY, FIG. SKATING, SWIMMING, ETC.
+TESTING DETERMINED PER NEEDS OF THE SPORT

500 EXERCISE MOVEMENTS TO TEST FOR AN ATHLETE/SUBJECT IN SPECIFIC SPORTS

FIG. 5

Test Report Functional Squat

Club Colorado Fitness

| | | | |
|---|---|---|---|
| Name: | Athletic Improvement Center | Clinician: | |
| Birthday: | 09/20/1970 | Referral: | |
| Test date: | 08/24/2007 | Involved: | AIC |
| Diagnosis: | | | |
| Notes: | | | |

5 SEC Isometric test 602

| | R 604 Non-involved | L 606 Involved | 608 Deficit |
|---|---|---|---|
| 610 Max. Force: | 404 N | 399 N | -1 % |
| Time to Max. Force: | 0.43 s | 2.12 s | 393 % |
| 612 Average Force: | 374 N | 347 N | -7 % |

Involved

Test Report Functional Squat

Club Colorado Fitness

| | | | |
|---|---|---|---|
| Name: | Athletic Improvement Center | Clinician: | |
| Birthday: | 09/20/1970 | Referral: | |
| Test date: | 08/24/2007 | Involved: | AIC |
| Diagnosis: | | | |
| Notes: | | | |

10 SEC Isometric test ~ 702

| | R (704) Non-involved | L (706) Involved | Deficit (708) |
|---|---|---|---|
| 710 ~ Max. Force: | 487 N | 529 N | 9 % |
| Time to Max. Force: | 0.62 s | 0.62 s | 0 % |
| 712 ~ Average Force: | 365 N | 323 N | -12 % |

714

Involved

Test Report Functional Squat

Club Colorado Fitness

MONITORED REHAB SYSTEMS

| | | | |
|---|---|---|---|
| Name: | Athletic Improvement Center | Clinician: | |
| Birthday: | 09/20/1970 | Referral: | |
| Test date: | 08/24/2007 | Involved: | AIC |
| Diagnosis: | | | |
| Notes: | | | |

Coordination Test 902

L 906 904 R 910 908

| Concentric | Involved | Non-involved | Deficit [%] |
|---|---|---|---|
| Weight [kg] | 15 | 15 | 0,0 |
| Duration [s] | 60 | 60 | 0,0 |
| Average [cm] | 0,31 | 0,53 | -41,5 |
| Deviation [cm] | 1,56 | 1,26 | 23,8 |
| 912 Correct position [%] | 7,0 | 7,1 | -1,4 |

| Eccentric | Involved | Non-involved | Deficit [%] |
|---|---|---|---|
| 914 Weight [kg] | 15 | 15 | 0,0 |
| Duration [s] | 60 | 60 | 0,0 |
| Average [cm] | -0,21 | -0,31 | -32,3 |
| Deviation [cm] | 1,43 | 1,41 | 1,4 |
| 916 Correct position [%] | 17,6 | 10,8 | 63,0 |

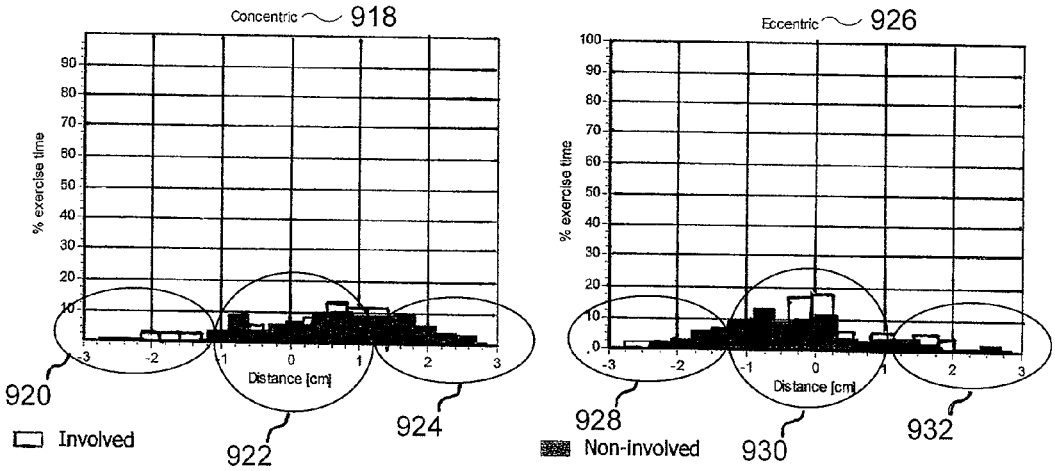

FIG. 9

Test Report Functional Squat

Club Colorado Fitness

MONITORED REHAB SYSTEMS

| | | | |
|---|---|---|---|
| Name: | Athletic Improvement Center | Clinician: | |
| Birthday: | 09/20/1970 | Referral: | |
| Test date: | 08/24/2007 | Involved: | AIC |
| Diagnosis: | | | |
| Notes: | | | |

Proprioceptive Test 1102

| | 1108 Non visible | 1110 Visible | 1112 Deficit [%] |
|---|---|---|---|
| Weight [kg] | 15 | 15 | |
| Duration [s] | 30 | 30 | |
| Correct position [mm] | 256 | 256 | |
| Average first movement [mm] | 264,1 | 257,8 | 2,4 |
| Deviation first movement [mm] | 11,9 | 17,7 | -32,8 |
| Average second movement [mm] | 261,3 | 262,0 | -0,3 |
| 1104 Deviation second movement [mm] | 14,4 | 24,1 | -40,2 |

1106

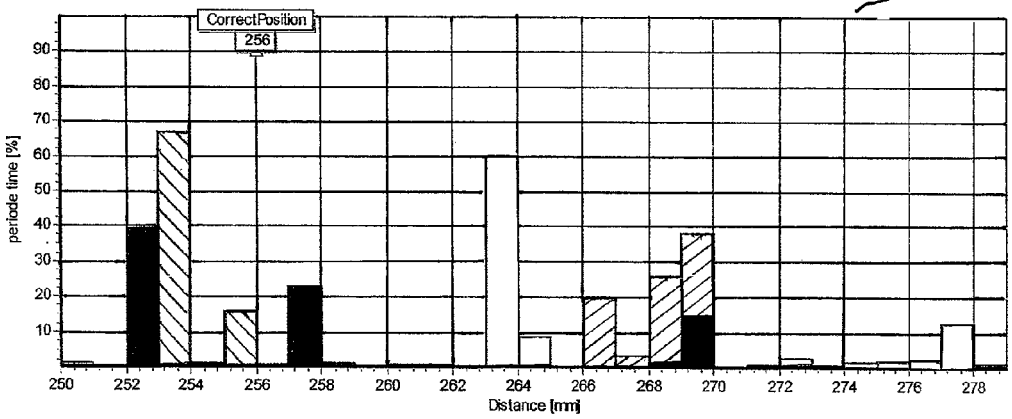

Marker first

No marker first

FIG. 11

Test Report Functional Squat

Club Colorado Fitness

MONITORED REHAB SYSTEMS

| | | | |
|---|---|---|---|
| Name: | Athletic Improvement Center | Clinician: | |
| Birthday: | 09/20/1970 | Referral: | |
| Test date: | 08/24/2007 | Involved: | AIC |
| Diagnosis: | | | |
| Notes: | | | |

Proprioceptive Test 1202

| | 1208 Non visible | 1210 Visible | 1212 Deficit [%] |
|---|---|---|---|
| Weight [kg] | 15 | 15 | |
| Duration [s] | 30 | 30 | |
| Correct position [mm] | 246 | 246 | |
| Average first movement [mm] | 229,3 | 261,5 | -12,3 |
| Deviation first movement [mm] | 21,8 | 6,6 | 230,3 |
| Average second movement [mm] | 236,9 | 264,2 | -10,3 |
| 1204 Deviation second movement [mm] | 16,6 | 2,7 | 514,8 |

1206

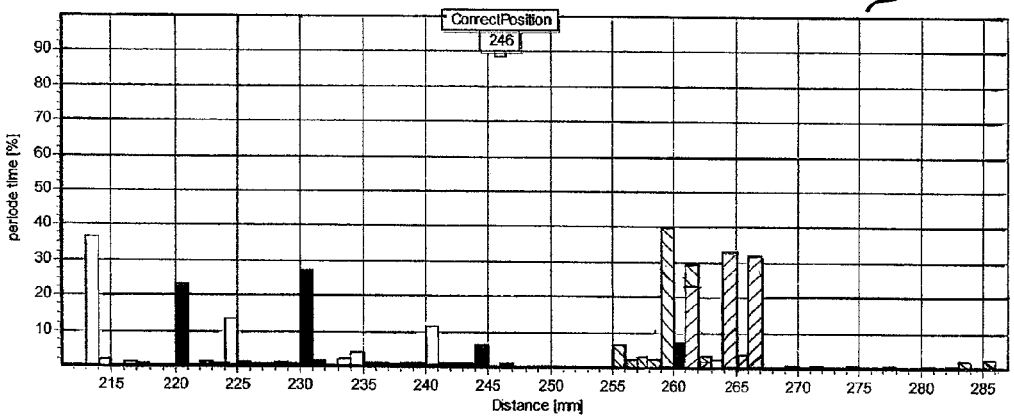

Marker first  No marker first

FIG. 12

Test Report Functional Squat

Club Colorado Fitness

MONITORED REHAB SYSTEMS

| | | | |
|---|---|---|---|
| Name: | Athletic Improvement Center | Clinician: | |
| Birthday: | 09/20/1970 | Referral: | |
| Test date: | 08/24/2007 | Involved: | AIC |
| Diagnosis: | | | |
| Notes: | | | |

Endurance Capacity Test 1302

1310

| Concentric | L 1306 Involved | 1304 R Non-involved | Deficit [%] 1308 |
|---|---|---|---|
| Weight [kg] | 25 | 25 | 0,0 |
| Repetitions | 30 | 30 | 0,0 |
| 1312 Peak Force [N] | 335 | 338 | -0,9 |
| Position Peak Force [cm] | 20,9 | 21,1 | -0,9 |
| 1314 Total Work [Nm] | 2141 | 2273 | -5,8 |
| Average Power [W] | 49,0 | 57,0 | -14,0 |
| 1316 Maximal Speed [cm/s] | 76,0 | 87,0 | -12,6 |

| Eccentric | Involved | Non-involved | Deficit [%] |
|---|---|---|---|
| 1318 Weight [kg] | 25 | 25 | 0,0 |
| Repetitions | 30 | 30 | 0,0 |
| 1320 Peak Force [N] | 248 | 252 | -1,6 |
| Position Peak Force [cm] | 13,2 | 13,2 | 0,0 |
| 1322 Total Work [Nm] | 1626 | 1758 | -7,5 |
| Average Power [W] | 46,6 | 51,9 | -10,2 |
| 1324 Maximal Speed [cm/s] | 74,0 | 79,0 | -6,3 |

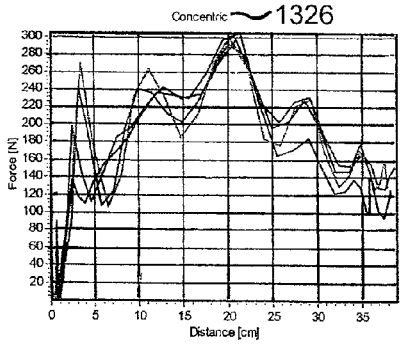

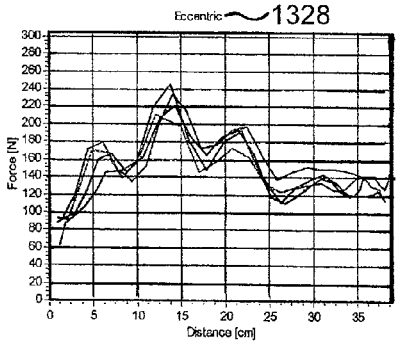

Involved Last repetition

Non-involved Last repetition

FIG. 13

Test Report Functional Squat

Club Colorado Fitness

MONITORED REHAB SYSTEMS

| | | | |
|---|---|---|---|
| Name: | Athletic Improvement Center | Clinician: | |
| Birthday: | 09/20/1970 | Referral: | |
| Test date: | 08/24/2007 | Involved: | AIC |
| Diagnosis: | | | |
| Notes: | | | |

STRENGTH Capacity Test 1402

| 1410 Concentric | L 1406 Involved | 1404 R Non-involved | 1408 Deficit [%] |
|---|---|---|---|
| Weight [kg] | 40 | 40 | 0,0 |
| Repetitions | 10 | 10 | 0,0 |
| 1412 Peak Force [N] | 505 | 498 | 1,4 |
| Position Peak Force [cm] | 20,9 | 21,1 | -0,9 |
| Total Work [Nm] | 1287 | 1223 | 5,2 |
| 1414 Average Power [W] | 75,9 | 63,5 | 19,5 |
| Maximal Speed [cm/s] | 67,0 | 64,0 | 4,7 |

| Eccentric | Involved | Non-involved | Deficit [%] |
|---|---|---|---|
| 1416 Weight [kg] | 40 | 40 | 0,0 |
| Repetitions | 10 | 10 | 0,0 |
| 1418 Peak Force [N] | 428 | 410 | 4,4 |
| Position Peak Force [cm] | 22,4 | 36,2 | -38,1 |
| Total Work [Nm] | 1112 | 1086 | 2,4 |
| 1420 Average Power [W] | 67,2 | 54,0 | 24,4 |
| Maximal Speed [cm/s] | 55,0 | 49,0 | 12,2 |

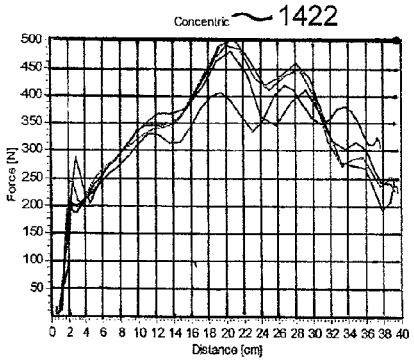

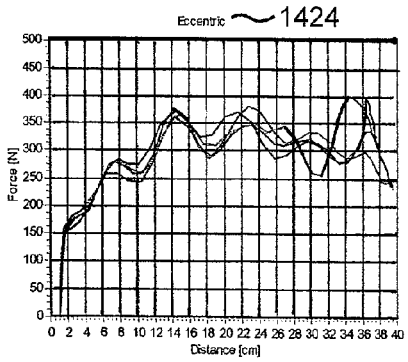

Involved Last repetition

Non-involved Last repetition

FIG. 14

2202 1) DEEP SQUAT 2204 2) HURDLE STEP 2206 3) INLINE LUNGE 2208 4) SHOULDER MOBILITY 2210 5) ACTIVE STRAIGHT LEG RAISE 2212 6) TRUNK STABILITY 2214 7) ROTARY STABILITY

2200 POTENTIAL EXERCISE MOVEMENTS FOR USE WITH FUNCTIONAL MOVEMENT SCREEN (FMS)

FIG. 22

2500 FMS INLINE LUNGE EXERCISE MOVEMENT

2600 FMS SHOULDER MOBILITY EXERCISE MOVEMENT

LOWER EXTREMITY TEST

ATHLETIC IMPROVEMENT center

| INITIAL TEST | | | | RE-TEST | | | | | |
|---|---|---|---|---|---|---|---|---|---|
| Lower Extremity: Squat | | | | Lower Extremity: Squat | | | | | |
| Name: | | | | | | | | | |
| Date: 11/01/06 | | | | Date: 12/26/06 | | | | | |
| | Right | Left | % Difference | | Right | Left | % Difference | R % Improved | L % Improved |
| 5 SEC ISOMETRIC TEST | | | | 5 SEC ISOMETRIC TEST | | | | | |
| Max Force (N) | 954 | 1118 | | Max Force (N) | 1033 | 1065 | | | |
| Max Force (LBS) | 214 | 251 | -17.19% | Max Force (LBS) | 232 | 239 | -3.10% | -7.65% | 4.98% |
| Average Force (N) | 902 | 1002 | | Average Force (N) | 962 | 1000 | | | |
| Average Force (LBS) | 203 | 225 | -11.09% | Average Force (LBS) | 216 | 225 | -3.95% | -6.24% | 0.20% |
| 10 SEC ISOMETRIC TEST | | | | 10 SEC ISOMETRIC TEST | | | | | |
| Max Force (N) | 992 | 1067 | | Max Force (N) | 924 | 945 | | | |
| Max Force (LBS) | 223 | 240 | -7.56% | Max Force (LBS) | 208 | 212 | -2.27% | 7.36% | 12.91% |
| Average Force (N) | 922 | 1001 | | Average Force (N) | 868 | 914 | | | |
| Average Force (LBS) | 207 | 225 | -8.57% | Average Force (LBS) | 195 | 205 | -5.30% | 6.22% | 9.52% |
| COORDINATION TEST | | | | COORDINATION TEST | | | | | |
| Concentric (% Correct Position) | 28.4 | 26 | 8.45% | Concentric (% Correct Position) | 34.3 | 24 | 30.03% | -17.20% | 8.33% |
| Eccentric (% Correct Postion) | 37.5 | 37.9 | -1.07% | Eccentric (% Correct Postion) | 39.7 | 46 | -15.87% | -5.54% | -17.61% |
| PROPRIOCEPTION TEST | | | | PROPRIOCEPTION TEST | | | | | |
| Deviation From Correct Position (% | 84.8 | 91.4 | -7.78% | Deviation From Correct Position (% | 0 | 0.2 | #DIV/0! | #DIV/0! | 45600.00% |
| ENDURANCE CAPACITY TEST | | | | ENDURANCE CAPACITY TEST | | | | | |
| Concentric | | | | Concentric | | | | | |
| Peak Force (N) | 543 | 552 | | Peak Force (N) | 539 | 559 | | | |
| Peak Force (LBS) | 122 | 124 | -1.66% | Peak Force (LBS) | 121 | 126 | -3.71% | 0.74% | -1.26% |
| Max Speed (cm/sec) | 71 | 74 | -4.23% | Max Speed (cm/sec) | 72 | 72 | 0.00% | -1.39% | 2.78% |
| Total Work (Nm) | 3378 | 3503 | -3.70% | Total Work (Nm) | 3541 | 3789 | -7.00% | -4.60% | -7.55% |
| Eccentric | | | | Eccentric | | | | | |
| Peak Force (N) | 507 | 516 | | Peak Force (N) | 472 | 511 | | | |
| Peak Force (LBS) | 114 | 116 | -1.78% | Peak Force (LBS) | 106 | 115 | -8.26% | 7.42% | 0.98% |
| Max Speed (cm/sec) | 69 | 76 | -10.14% | Max Speed (cm/sec) | 70 | 73 | -4.29% | -1.43% | 4.11% |
| Total Work (Nm) | 2561 | 2673 | -4.37% | Total Work (Nm) | 2778 | 2901 | -4.43% | -7.81% | -7.86% |
| STRENGTH CAPACITY TEST | | | | STRENGTH CAPACITY TEST | | | | | |
| Concentric | | | | Concentric | | | | | |
| Peak Force (N) | 820 | 879 | | Peak Force (N) | 887 | 855 | | | |
| Peak Force (LBS) | 184 | 198 | -7.20% | Peak Force (LBS) | 199 | 192 | 3.61% | -7.55% | 2.81% |
| Average Power (Watts) | 147 | 163 | -11.19% | Average Power (Watts) | 184 | 197 | -7.07% | -20.33% | -17.26% |
| Eccentric | | | | Eccentric | | | | | |
| Peak Force (N) | 697 | 752 | | Peak Force (N) | 766 | 772 | | | |
| Peak Force (LBS) | 157 | 169 | -7.89% | Peak Force (LBS) | 172 | 174 | -0.78% | -9.01% | -2.59% |
| Average Power (Watts) | 119 | 160 | -34.40% | Average Power (Watts) | 162 | 185 | -14.20% | -26.60% | -13.62% |
| KEY: (+) Number= L Deficit / (-) Number = R Deficit | | | | KEY: (+) Number= Initial test better / (-) Number = Retest better | | | | | |

FIG. 30A

UPPER EXTREMITY TEST

ATHLETIC IMPROVEMENT center

| INITIAL TEST | | | | RE-TEST | | | | | |
|---|---|---|---|---|---|---|---|---|---|
| Upper Extremity: Lats | | | | Upper Extremity: Lats | | | | | |
| Name: | | | | | | | | | |
| Date: 11/1/06 | | | | Date: 12/26/06 | | | | | |
| | Right | Left | % Difference | | Right | Left | % Difference | R % Improved | L % Improved |
| 5 SEC ISOMETRIC TEST | | | | 5 SEC ISOMETRIC TEST | | | | | |
| Max Force (N) | | | | Max Force (N) | | | | | |
| Max Force (LBS) | 0 | 0 | #DIV/0! | Max Force (LBS) | 0 | 0 | #DIV/0! | #DIV/0! | #DIV/0! |
| Average Force (N) | | | | Average Force (N) | | | | | |
| Average Force (LBS) | 0 | 0 | #DIV/0! | Average Force (LBS) | 0 | 0 | #DIV/0! | #DIV/0! | #DIV/0! |
| 10 SEC ISOMETRIC TEST | | | | 10 SEC ISOMETRIC TEST | | | | | |
| Max Force (N) | | | | Max Force (N) | | | | | |
| Max Force (LBS) | 0 | 0 | #DIV/0! | Max Force (LBS) | 0 | 0 | #DIV/0! | #DIV/0! | #DIV/0! |
| Average Force (N) | | | | Average Force (N) | | | | | |
| Average Force (LBS) | 0 | 0 | #DIV/0! | Average Force (LBS) | 0 | 0 | #DIV/0! | #DIV/0! | #DIV/0! |
| COORDINATION TEST | | | | COORDINATION TEST | | | | | |
| Concentric (% Correct Position) | 2.8 | 6.9 | -146.43% | Concentric (% Correct Position) | 5.8 | 4.3 | 25.86% | -51.72% | 60.47% |
| Eccentric (% Correct Postion) | 23.6 | 12 | 49.15% | Eccentric (% Correct Postion) | 4.1 | 15.4 | -275.61% | 475.61% | -22.08% |
| PROPRIOCEPTION TEST | | | | PROPRIOCEPTION TEST | | | | | |
| Deviation From Correct Position (% | 100 | 99.3 | 0.70% | Deviation From Correct Position (% | 0 | 0 | #DIV/0! | #DIV/0! | #DIV/0! |
| ENDURANCE CAPACITY TEST | | | | ENDURANCE CAPACITY TEST | | | | | |
| Concentric | | | | Concentric | | | | | |
| Peak Force (N) | 488 | 495 | | Peak Force (N) | 267 | 309 | | | |
| Peak Force (LBS) | 110 | 111 | -1.43% | Peak Force (LBS) | 60 | 69.5 | -15.73% | 82.77% | 60.19% |
| Max Speed (cm/sec) | 551 | 568 | -3.09% | Max Speed (cm/sec) | 605 | 605 | 0.00% | -8.93% | -6.12% |
| Total Work (Nm) | 1157 | 1169 | -1.04% | Total Work (Nm) | 6919 | 7058 | -2.01% | -83.28% | -83.44% |
| Eccentric | | | | Eccentric | | | | | |
| Peak Force (N) | 645 | 603 | | Peak Force (N) | 395 | 391 | | | |
| Peak Force (LBS) | 145 | 136 | 6.51% | Peak Force (LBS) | 88.8 | 87.9 | 1.01% | 63.29% | 54.22% |
| Max Speed (cm/sec) | 750 | 670 | 10.67% | Max Speed (cm/sec) | 521 | 493 | 5.37% | 43.95% | 35.90% |
| Total Work (Nm) | 5692 | 5426 | 4.67% | Total Work (Nm) | 3456 | 3660 | -5.90% | 64.70% | 48.25% |
| STRENGTH CAPACITY TEST | | | | STRENGTH CAPACITY TEST | | | | | |
| Concentric | | | | Concentric | | | | | |
| Peak Force (N) | 570 | 547 | | Peak Force (N) | 565 | 567 | | | |
| Peak Force (LBS) | 128 | 123 | 4.04% | Peak Force (LBS) | 127 | 127 | -0.35% | 0.88% | -3.53% |
| Average Power (Watts) | 469 | 436 | 7.04% | Average Power (Watts) | 741 | 867 | -17.00% | -36.71% | -49.71% |
| Eccentric | | | | Eccentric | | | | | |
| Peak Force (N) | 452 | 425 | | Peak Force (N) | 454 | 429 | | | |
| Peak Force (LBS) | 102 | 95.5 | 5.97% | Peak Force (LBS) | 102 | 96.4 | 5.51% | -0.44% | -0.93% |
| Average Power (Watts) | 433 | 493 | -13.86% | Average Power (Watts) | 483 | 449 | 7.04% | -10.35% | 9.80% |
| KEY: (+) Number= L Deficit / (-) Number = R Deficit | | | | KEY: (+) Number= Initial test better / (-) Number = Retest better | | | | | |

FIG. 30B

Name: [redacted]

Age:

Sport:

ATHLETIC IMPROVEMENT CENTER

| TEST: | PRETEST: RAW SCORE: | POSTTEST: RAW SCORE: | (PRE)FINAL | (POST)FINAL | COMMENTS: |
|---|---|---|---|---|---|
| DEEP SQUAT | 3 | 3 | 3 | 3 | |
| HURDLE STEP | | | | | |
| RIGHT | 3 | 3 | | | |
| LEFT | 3 | 3 | 3 | 3 | |
| INLINE LUNGE | | | | | |
| RIGHT | 3 | 3 | | | |
| LEFT | 3 | 3 | 3 | 3 | |
| SHOULDER MOBILITY | | | | | |
| RIGHT | 3 | 3 | | | |
| LEFT | 3 | 3 | 3 | 3 | |
| ACTIVE SLR | | | | | Tight Hamstrings: Pre |
| RIGHT | 2 | 3 | | | Tight Psoas: Pre |
| LEFT | 2 | 3 | 2 | 3 | Tight ITB: Pre |
| TRUNK STABILITY | 3 | 3 | 3 | 3 | |
| ROTARY STABILITY | | | | | |
| RIGHT | 2 | 3 | | | |
| LEFT | 2 | 2 | 2 | 2 | |
| TOTAL: | | | 19 | 20 | |
| TOTAL POSSIBLE: | | | 21 | 21 | |

FIG. 30C

Athletic Improvement Center

Sport Specific Analysis | Sport: Cycling

Name: [redacted]

| Comparisons | INITIAL TEST | | Comparisons | RETEST | |
|---|---|---|---|---|---|
| | MRS | BIKE | | MRS | BIKE |
| STRENGTH LE | MRS | 5 min Power | STRENGTH LE | MRS | 5 min Power |
| AVG Power (Watts) | 588 | 332 | AVG Power (Watts) | 728 | 0 |
| % Of MRS TEST | 56% | | % Of MRS TEST | 0% | |
| Goal | 85 - 90% | | | | |
| ENDURANCE LE | MRS | 5 min Power | ENDURANCE LE | MRS | 5 min Power |
| AVG Power (Watts) | 571 | 332 | AVG Power (Watts) | 580 | 0 |
| % Of MRS TEST | 58% | | % Of MRS TEST | 0% | |
| Goal | 60 - 65% | | | | |
| STRENGTH LE | MRS | 20 min Power | STRENGTH LE | MRS | 20 min Power |
| AVG Power (Watts) | 588 | 246 | AVG Power (Watts) | 728 | 0 |
| % Of MRS TEST | 42% | | % Of MRS TEST | 0% | |
| Goal | 80 - 85% | | | | |
| ENDURANCE LE | MRS | 20 min Power | ENDURANCE LE | MRS | 20 min Power |
| AVG Power (Watts) | 571 | 246 | AVG Power (Watts) | 580 | 0 |
| % Of MRS TEST | 43% | | % Of MRS TEST | 0% | |
| Goal | 60 - 65% | | | | |

NOTES

Weight Amount is Set From 5 sec Max Test on the MRS

Below is your chart for you starting weight only

Round the weight down to the closet weight on the machine

Increase weight when the last 3 reps of the final set is easy

Increase weight by in 5 to 10 lb increments

Lunges & Step Ups are determined by 1/2 the total since they are 1 leg exercises Lat Pull Down is determined by Strength Test Preparatory = 40% Max / Power = 75% Max / Neuromuscular = 60% max Formulas for weight determination

| Exercise | 5 sec Iso Test | Preparatory | Power | Neuromuscular | Notes |
|---|---|---|---|---|---|
| Squat | 430 | 172 | 322.5 | 258 | |
| Leg Press | 430 | 172 | 322.5 | 258 | |
| Lunges | 215 | 86 | 161.25 | 129 | |
| Step ups | 215 | 86 | 161.25 | 129 | |
| Calves | 430 | 172 | 322.5 | 258 | |
| Lat Pull Down | 230 | 92 | 172.5 | 138 | |

FIG. 30D

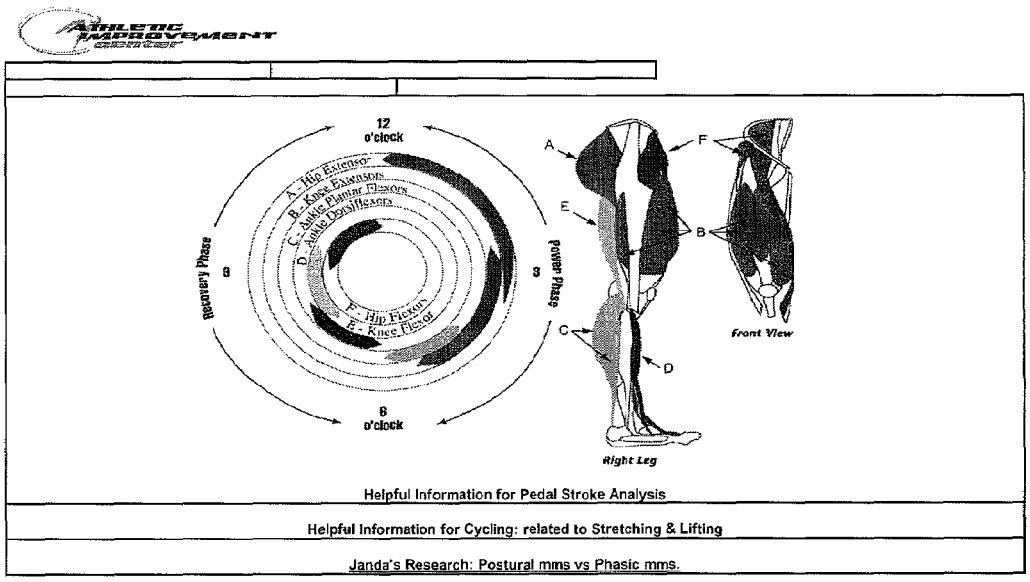

Janda advocates that all mms in the body are either postural or phasic.

Therefore postural mms respond to dysfunction by tightening and phasic mms by weakening.

In every agonist /antagonist mm relationship in the body one mm functions as the postural mm.

The companion mm then functions as the phasic mm.

Therefore in order to have maximal effectiveness Janda advocates stretching the postural mm prior to strengthening the the phasic mm.

The flow chart below is designed to assist you in understanding these relationships as it relates to cycling.

| Postural MM | Primary Action | Motion Restricted | Phasic MM | Primary Action | Motion Weakened | Cycling Activity Affected |
|---|---|---|---|---|---|---|
| *Group 1* | | | *Group 1* | | | |
| Iliopsoas | Hp Flexion | Hip Ext | Glut Max | Hip Ext | Hip Ext | Power Output: All |
| TFL | Hp Flexion | Hip Ext | Glut Max | Hip Ext | Hip Ext | Power Output: All |
| *Group 2* | | | *Group 2* | | | |
| Hamstrings | Knee Flex / Hip Ext | Knee Ext / Hip Flex | Quads: VMO | Knee Ext / Hip Flex | Knee Ext / Hip Flex | Power Output: Tempo & Sprint |
| *Group 3* | | | *Group 3* | | | |
| Hip Adductors | Hip Add / Hip Flex | Hip Abd / Hip Ext | Glut Medius | Hip Abd / Hip Ext | Hip Abd / Hip Ext | Power Output: Climbing |
| *Group 4* | | | *Group 4* | | | |
| Gastroc / Soleus | P Flex / Knee Flex | D Flex | Dorsiflexors | D Flex | D Flex | Inefficient Pedal Stroke |
| *Group 5* | | | *Group 5* | | | |
| Erector Spinea | Trunk Ext | Trunk Flex | Abdominals | Trunk Flex / Diaphragm | Trunk Flex / Diaphragm | Limits Oxygen Uptake |
| *Group 6* | | | *Group 6* | | | |
| Piriformis | ER Hip / Abd Flexed Hip | Breaks the Rule | Piriformis | ER Hip / Abd Flexed Hip | ER Hip / Abd Flexed Hip | Inefficient Pedal Stroke |
| *Group 7* | | | *Group 7* | | | |
| Upper Trapezius | Elevation of Scapula | Depression of Scapula | Latissimus Dorsi | Depression of Scapula | Depression of Scapula | Limits Oxygen Uptake |
| Levetor Scapula | Elevation of Scapula | Depression of Scapula | Latissimus Dorsi | Depression of Scapula | Depression of Scapula | Limits Oxygen Uptake |
| *Group 8* | | | *Group 8* | | | |
| Pec Major | Shoulder Flex | Shoulder Ext | Mid / Lower Trap | Retraction of Scapula | Retraction of Scapula | Limits Oxygen Uptake |
| Pec Minor | Protraction of Scapula | Retraction of Scapula | Rhomboids | Retraction of Scapula | Retraction of Scapula | Limits Oxygen Uptake |
| *Group 9* | | | *Group 9* | | | |
| Cervical Erector Spinea | Cervical Ext | Cervical Flexion | Ant Cervical MMs | Cervical Flexion | Cervical Flexion | Limits Oxygen Uptake |

FIG. 30E

| Helpful Information | Sport: Football |
|---|---|
| Name: | |

Helpful Information for Football: related to Stretching & Lifting

Janda's Research: Postural mms vs Phasic mms.

Janda advocates that all mms in the body are either postural or phasic.

Therefore postural mms respond to dysfunction by tightening and phasic mms by weakening.

In every agonist /antagonist mm relationship in the body one mm functions as the postural mm.

The companion mm then functions as the phasic mm.

Therefore in order to have maximal effectiveness Janda advocates stretching the postural mm prior to strengthening the the phasic mm.

The flow chart below is designed to assist you in understanding these relationships as it relates to cycling.

| Postural MM | Primary Action | Motion Restricted | Phasic MM | Primary Action | Motion Weakened | Football Activity Affected |
|---|---|---|---|---|---|---|
| ***Group 1*** | | | ***Group 1*** | | | |
| Iliopsoas | Hip Flexion | Hip Ext | Glut Max | Hip Ext | Hip Ext | Power, Explosion, Lateral Movement |
| TFL | Hip Flexion | Hip Ext | Glut Max | Hip Ext | Hip Ext | Power, Explosion, Lateral Movement |
| ***Group 2*** | | | ***Group 2*** | | | |
| Hamstrings | Knee Flex / Hip Ext | Knee Ext / Hip Flex | Quads: VMO | Knee Ext / Hip Flex | Knee Ext / Hip Flex | Power, Explosion, Deep Squatting |
| ***Group 3*** | | | ***Group 3*** | | | |
| Hip Adductors | Hip Add / Hip Flex | Hip Abd / Hip Ext | Glut Medius | Hip Abd / Hip Ext | Hip Abd / Hip Ext | Lateral Movement in First Steps |
| ***Group 4*** | | | ***Group 4*** | | | |
| Gastroc / Soleus | P Flex / Kree Flex | D Flex | Dorsiflexors | D Flex | D Flex | Explosion in 1st Step |
| ***Group 5*** | | | ***Group 5*** | | | |
| Erector Spinea | Trunk Ext | Trunk Flex | Abdominals | Trunk Flex / Diaphragm | Trunk Flex / Diaphragm | Power, Stability when Hitting |
| ***Group 6*** | | | ***Group 6*** | | | |
| Piriformis | ER Hip / Abd Flexed Hip | Breaks the Rule | Piriformis | ER Hip / Abd Flexed Hip | ER Hip / Abd Flexed Hip | Lateral Movement Steps |
| ***Group 7*** | | | ***Group 7*** | | | |
| Upper Trapezius | Elevation of Scapula | Depression of Scapula | Latissimus Dorsi | Depression of Scapula | Depression of Scapula | |
| Levetor Scapula | Elevation of Scapula | Depression of Scapula | Latissimus Dorsi | Depression of Scapula | Depression of Scapula | Hands Up Quick for Blocking |
| ***Group 8*** | | | ***Group 8*** | | | |
| Pec Major | Shoulder Flex | Shoulder Ext | Mid / Lower Trap | Retraction of Scapula | Retraction of Scapula | Good Blocking Form |
| Pec Minor | Protraction of Scapula | Retraction of Scapula | Rhomboids | Retraction of Scapula | Retraction of Scapula | Good Blocking Form |
| ***Group 9*** | | | ***Group 9*** | | | |
| Cervical Erector Spinea | Cervical Ext | Cervical Flexion | Ant Cervical MMs | Cervical Flexion | Cervical Flexion | Stability |

FIG. 30F

| NAME: | | | | PROGRAM | PROGRAM | PROGRAM | PROGRAM |
|---|---|---|---|---|---|---|---|
| DEFICITS: | Nov-06 | Dec-06 | Jan-07 | SERIES 1: | | SERIES 3 | |
| *FMS* | 11/1 | 12/1 | 1/1 | *Stretching:* | | *Proprio & Coord* | |
| *Weakness* | 11/2 | 12/2 | 1/2 | Hamstring | 5 reps x 30 sec hold | RNT | |
| Weak Core | 11/3 | 12/3 | 1/3 | Hip Adductors | 5 reps x 30 sec hold | | |
| | 11/4 | 12/4 | 1/4 | ITB | 5 reps x 30 sec hold | 1/2 Kneel Chops | 2 sets x 15 reps |
| | 11/5 | 12/5 | 1/5 | Hip Flexors | 5 reps x 30 sec hold | 1/2 Kneel Lifts | 2 sets x 15 reps |
| *Tightness* | 11/6 | 12/6 | 1/6 | Low Back / Lats / Sweep | 10 reps x 5 sec hold | | |
| Bilat Hamstrings | 11/7 | 12/7 | 1/7 | *Pilates* | | Coordination Series | |
| Bilat Psoas ( Hip Flexors ) | 11/8 | 12/8 | 1/8 | The Hundred | 100 reps | Ball Squats | 10 -15 reps |
| Bilat ITB | 11/9 | 12/9 | 1/9 | The Rollup | 8-10 reps | Single Leg Bridge | 10 -15 reps |
| *MRS* | 11/10 | 12/10 | 1/10 | Single Leg | 8-10 reps | Dip Bridge | 10 -15 reps |
| *Lower Extremity* | 11/11 | 12/11 | 1/11 | Double Leg | 8-10 reps | Plank Holds | 10 -15 reps |
| 5 sec Isometric ® | 11/12 | 12/12 | 1/12 | Swan Dive | 8-10 reps | Pike Plank Lifts | 10 -15 reps |
| Bilat Coordination | 11/13 | 12/13 | 1/13 | Side Series | 8-10 reps | Side Walks | 1 min each side |
| Bilateral Proprioception | 11/14 | 12/14 | 1/14 | SERIES 2: | | | |
| Avg Power | 11/15 | 12/15 | 1/15 | *Exercises & Weight* | *Power: 5 sets x 6-8 reps* | R Leg Only | |
| | 11/16 | 12/16 | 1/16 | Squats | Squats = 323 lbs | 4 sets both legs | |
| *Upper Extremity* | 11/17 | 12/17 | 1/17 | Leg Press | Leg Press = 323 lbs | 1 set at 1/2 the weight 1 | |
| Bilat Coordination | 11/18 | 12/18 | 1/18 | Lunges | Lunges = 161 lbs | R leg | |
| Bilateral Proprioception | 11/19 | 12/19 | 1/19 | Step Ups | Step Ups = 161 lbs | | |
| Avg Power | 11/20 | 12/20 | 1/20 | Calves | Calves = 323 lbs | | |
| | 11/21 | 12/21 | 1/21 | Lat Pull Down | Lat Pull Down = 172 lbs | | |
| *CODES:* | 11/22 | 12/22 | 1/22 | | | | |
| Series 1 | 11/23 | 12/23 | 1/23 | SERIES 2: | | | |
| Series 2: Prep | 11/24 | 12/24 | 1/24 | *Preparatory: 3 sets x 15 reps* | *Neuromuscular: 5 sets x 20* | R Leg Only | |
| Series 2: Power Strength | 11/25 | 12/25 | 1/25 | Squats = 172 lbs | Squats = 258 lbs | 4 sets both legs | |
| Series 2: Power Endurance | 11/26 | 12/26 | 1/26 | Leg Press = 172 lbs | Leg Press = 258 lbs | 1 set at 1/2 the weight 1 | |
| Series 2: NM | 11/27 | 12/27 | 1/27 | Lunges = 86 lbs | Lunges = 129 lbs | R leg | |
| Series 3 | 11/28 | 12/28 | 1/28 | Step Ups = 86 lbs | Step Ups = 129 lbs | | |
| Series 1 & 3 | 11/29 | 12/29 | 1/29 | Calves = 172 lbs | Calves = 258 lbs | | |
| Stretching Only | 11/30 | 12/30 | 1/30 | Lat Pull Down = 92 lbs | Lat Pull Down = 138 lbs | | |
| OFF | | 12/31 | 1/31 | | | | |

FIG. 30G

| Weight Program | | Notes & Special Instruction | Date / Weight | Date / Weight | Date / Weight | Date / Weight | Date / Weight | Date / Weight | Date / Weight | Date / Weight | Date / Weight | Date / Weight | Date / Weight | Date / Weight | Date / Weight | Date / Weight |
|---|---|---|---|---|---|---|---|---|---|---|---|---|---|---|---|---|
| *Power: Endurance* | *Sets & Reps / Weight* | | | | | | | | | | | | | | | |
| Squats | 3 x 12-15 reps | 75 % of current weight | | | | | | | | | | | | | | |
| Leg Press | 3 x 12-15 reps | 75 % of current weight | | | | | | | | | | | | | | |
| Lunges | 3 x 12-15 reps | 75 % of current weight | | | | | | | | | | | | | | |
| Step Ups | 3 x 12-15 reps | 75 % of current weight | | | | | | | | | | | | | | |
| Standing Calf Raises | 3 x 12-15 reps | 75 % of current weight | | | | | | | | | | | | | | |
| Lat Pull Down (On Ball) | 3 x 12-15 reps | 75 % of current weight | | | | | | | | | | | | | | |
| *Power: Strength* | *Sets & Reps / Weight* | *R Leg Only* | | | | | | | | | | | | | | |
| Squats | 4 x 6 reps / | 1 x 6 reps | | | | | | | | | | | | | | |
| Leg Press | 4 x 6 reps / | 1 x 6 reps | | | | | | | | | | | | | | |
| Lunges | 4 x 6 reps / | 1 x 6 reps | | | | | | | | | | | | | | |
| Step Ups | 4 x 6 reps / | 1 x 6 reps | | | | | | | | | | | | | | |
| Standing Calf Raises | 4 x 6 reps / | 1 x 6 reps | | | | | | | | | | | | | | |
| Lat Pull Down (On Ball) | 4 x 6 reps / | | | | | | | | | | | | | | | |
| | Current Max Weight | | | | | | | | | | | | | | | |
| *Neuromuscular:* | *Sets & Reps / Weight* | *R Leg Only* | | | | | | | | | | | | | | |
| Squats | 4 x 20 reps / 258 lbs | 1 x 20 reps | | | | | | | | | | | | | | |
| Leg Press | 4 x 20 reps / 258 lbs | 1 x 20 reps | | | | | | | | | | | | | | |
| Lunges | 4 x 20 reps / 129 lbs | 1 x 20 reps | | | | | | | | | | | | | | |
| Step Ups | 4 x 20 reps / 129 lbs | 1 x 20 reps | | | | | | | | | | | | | | |
| Standing Calf Raises | 4 x 20 reps / 258 lbs | 1 x 20 reps | | | | | | | | | | | | | | |
| Lat Pull Down (On Ball) | 4 x 20 reps / 138 lbs | | | | | | | | | | | | | | | |

FIG. 30H

Bike Fit Form

Age: 22

Sport: Cycling

Email:

| Measures: | Measurements: For Power Test | Measurements: Post | Notes: |
|---|---|---|---|
| Bike Make and Model | Specialized S Works | | |
| Saddle Height | 72 cm Bottom Bracket to Top of Seat | | |
| Saddle Height Over Top Tube | 20.5 cm | | |
| Head Set Over Top Tube | 9 cm | | |
| Difference | 13.5 cm | | |
| Saddle Set Back (In Front of the Bottom Bracket) | 6.75 cm | | |
| Saddle to Handlebar Reach | 57 cm Handle Bars to Tip of Saddle | | |

FIG. 30I

Name: [redacted]
Age:
Sport: Cycling
Email:

ATHLETIC IMPROVEMENT center

| EST. HR MAX: | 205 | WEIGHT: | 160 | HEIGHT: | 71.5 | | BODY FAT: | | | | | | |
|---|---|---|---|---|---|---|---|---|---|---|---|---|---|
| | Initial Test | | | | | | RE TEST | | | | | | % IMP |
| DATE: 11/03/06 | | | | RANK | RANK | RANK | | | | RANK | RANK | RANK | |
| TEST: | 5 MIN | 20 MIN | 1 MIN | 5 MIN | 20 MIN | 1 MIN | 5 MIN | 20 MIN | 1 MIN | 5 MIN | 20 MIN | 1 MIN | |
| AVG WATTS: | 332 | 246 | 0 | Good | Moderate | 0 | | | | | | | |
| AVG HR: | 178 | 175 | 0 | 80% HRM | 79% HRM | 0 | | | | | | | |
| AVG RPM: | 92 | 93 | 0 | | | | | | | | | | |
| AVG MPH: | 25.1 | 22.5 | 0 | | | | | | | | | | |
| PEAK WATTS: | 199 | 205 | 0 | | | | | | | | | | |
| PEAK HR: | 408 | 359 | 0 | | | | | | | | | | |
| PEAK RPM | 102 | 104 | 0 | | | | | | | | | | |
| PEAK MPH: | 27.1 | 25.5 | 0 | | | | | | | | | | |
| DISTANCE: | 2.09 | 7.5 | 0 | | | | | | | | | | |
| PULSE POWER: | 581 | 488 | 0 | | | | | | | | | | |
| CALIBRATION: | 2.33 | 2.33 | 0 | | | | | | | | | | |
| 5 MIN | LEFT | VS | RIGHT | | | | LEFT | VS | RIGHT | | | | |
| SPIN | 70 | | 72 | | | | | | | | | | |
| AVG SPIN | 70 | | 70 | | | | | | | | | | |
| AVG TORQUE A | 101 | | 100 | | | | | | | | | | |
| % WATTS | 52 | | 48 | | | | | | | | | | |
| 20 MIN | LEFT | VS | RIGHT | | | | LEFT | VS | RIGHT | | | | |
| SPIN | 70 | | 71 | | | | | | | | | | |
| AVG SPIN | 68 | | 67 | | | | | | | | | | |
| AVG TORQUE A | 100 | | 101 | | | | | | | | | | |
| % WATTS | 50 | | 50 | | | | | | | | | | |
| 1 MIN | LEFT | VS | RIGHT | | | | LEFT | VS | RIGHT | | | | |
| SPIN | 0 | | 0 | | | | | | | | | | |
| AVG SPIN | 0 | | 0 | | | | | | | | | | |
| AVG TORQUE A | 0 | | 0 | | | | | | | | | | |
| % WATTS | 0 | | 0 | | | | | | | | | | |

FIG. 30J

METHOD FOR MEASURING PHYSICAL FITNESS AND CREATING ATHLETIC TRAINING REGIMENS FOR PARTICULAR SPORTS

BACKGROUND OF THE INVENTION

Competitive athletes and their trainers and coaches have always sought to develop training regimens and exercises to maximize athletic performance in particular sports, but objective testing and evaluation in a manner that can identify specific neuromuscular and muscular deficiencies in a manner that enables targeted development of specific training regimens to maximize athletic performance for individual athletes in specific sports has been lacking. Each person has different or unique physical characteristics, strengths, and weaknesses that may not necessarily be addressed and optimized by generalized exercise programs.

Some efforts have been made, of course, to test and address needs of individual athletes, such as the functional sports screening tests which are used with many athletes. A relatively comprehensive list of many of the functional sports screening tests has been compiled by the National Academy of Sports Medicine (NASM), of 26632 Agoura Road, Calabasas, Calif. 91302, and the functional movement screening test developed by Gray Cook and described in his book *Athletic Body in Balance*, by Gray Cook, published by Human Kinetics, 2003. The functional movement screen discussed by Gray Cook, which includes squat, step lunge, reach, leg raise, push-up, and rotational movements, addresses the mobility and stability of the body and stresses the importance of overall body balance. Gray Cook further stresses the need for overall body balance and the desire that the right and left side of the body maintain a balanced muscular performance profile. Such functional movement screening observation of the movements necessitates that a trainer/coach or the athlete himself or herself interpret and grade or score the relative performance of the athlete/subject on the various exercise movements on a scale from 0 for complete failure to 3 for complete success for each movement. Thus, the functional screening is somewhat subjective in that it is subject to the opinion of the coach/trainer, and it is difficult to have repeatable results between different coaches/trainers. The NASM functional sports screening tests, on the other hand, are measurements of the athlete/subject in sporting skills such as the 40 yard dash, the 300 meter shuttle run, and number pull-ups, thus measuring the final performance of an athlete/subject in a sports context, but not the individual muscle groups. The NASM tests also address things such as body mass/weight measurements and other more subjective tests such as a postural assessment.

BRIEF DESCRIPTION OF THE DRAWINGS

In the drawings,

FIG. 1 is an example listing of testing procedures and associated results for testing of lower extremities of the body using Monitored Rehab System (MRS) equipment.

FIG. 2 is an example listing of testing procedures and associated results for testing of upper extremities of the body using the MRS equipment.

FIG. 3 is an example listing of potential exercise movements for the upper and lower extremities using the MRS equipment.

FIG. 4 is an example listing of decision criteria creating a physical fitness regimen for an athlete/subject based on the results of testing with the MRS equipment.

FIG. 5 is an example listing of exercise movements to test an athlete/subject with the MRS equipment for specific desired sports.

FIG. 9 is an example printout of results for a coordination test using the MRS rehabilitation equipment.

FIG. 11 is an example printout of results for a proprioception test on the right limb (leg) using the MRS rehabilitation equipment.

FIG. 12 is an example printout of results for a proprioception test on the left limb (leg) using the MRS rehabilitation equipment.

FIG. 13 is an example printout of results for an endurance capacity test on the MRS rehabilitation equipment.

FIG. 14 is a printout of the results for a strength capacity test on the MRS rehabilitation equipment.

FIG. 22 is a listing of example exercise movements that can be used with the functional movement screen (FMS).

FIG. 30A is an example printout of lower extremity test results of a spreadsheet tool for the physical fitness regimen.

FIG. 30B is an example printout of upper extremity test results of a spreadsheet tool for the physical fitness regimen.

FIG. 30C is an example printout of Functional Movement Screen (FMS) test results of a spreadsheet tool for the physical fitness regimen.

FIG. 30D is an example printout of a summary of test results of a spreadsheet tool for the physical fitness regimen.

FIG. 30E is an example printout of helpful information of a spreadsheet tool for the physical fitness regimen relating to cycling FIG. 30F is an example printout of helpful information of a spreadsheet tool for the physical fitness regimen relating to football.

FIG. 30G is an example printout of the physical fitness regimen created for an example athlete/subject of a spreadsheet tool for the physical fitness regimen.

FIG. 30H is an example printout of a checklist for an example athlete performing the physical fitness regimen of a spreadsheet tool for the physical fitness regimen.

FIG. 30I is an example printout of a bike fit for a bicyclist of a spreadsheet tool for the physical fitness regimen.

FIG. 30J is an example printout of the test results for a stationary bike test of a spreadsheet tool for the physical fitness regimen.

DETAILED DESCRIPTION OF THE INVENTION

Figure 6:
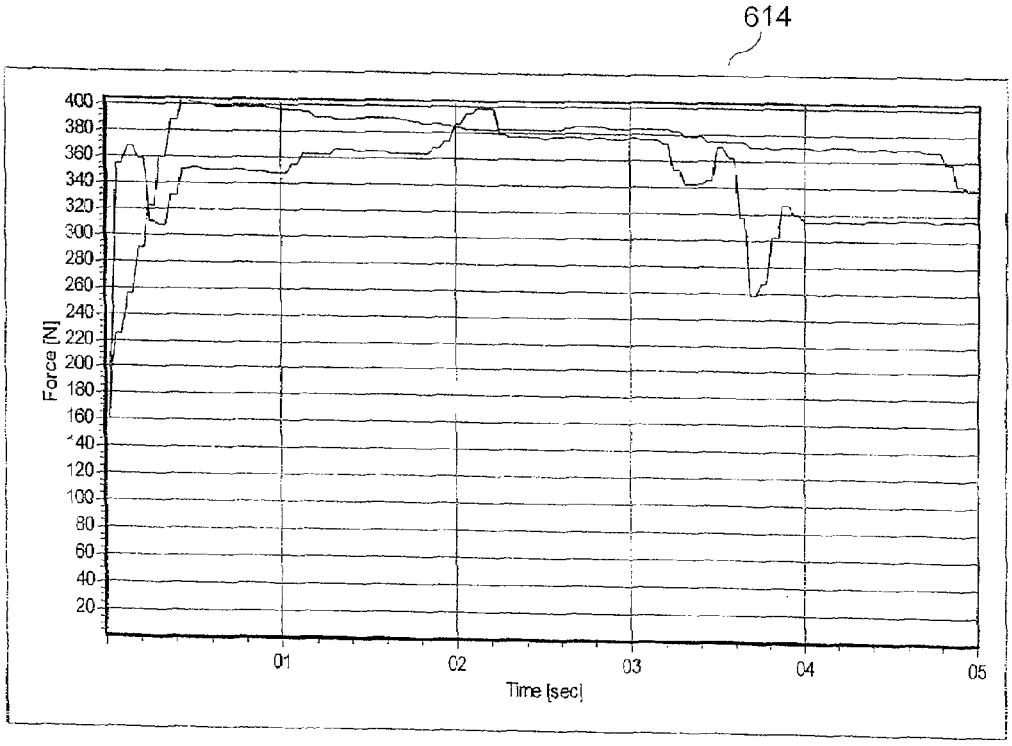
FIG. 6 is an example printout of results for a five second isometric test using the MRS rehabilitation equipment.

The physical fitness measuring and training regimens described herein utilize rehabilitation equipment to obtain measurements that indicate athletic fitness and to identify in an objective, quantified, accurate, and repeatable manner deficiencies in muscle groups that hamper athletic performance for particular sports. While such rehabilitation equipment is well-known and readily available, it has not heretofore been used in the manner described herein to improve and maximize athletic performance for particular sports. For example, using such equipment, an athletic coach/trainer can measure objectively, quantitatively, accurately, and repeatably the neuromuscular and muscular performance of an athlete as well as neuromuscular and muscular performance differences between the right side and the left side of the athlete's body, i.e., right-to-left-side or side-to-side muscular performance deficit in the upper extremities and/or the lower extremities of the athlete's body. By measuring such neuromuscular and muscular performance and such side-to-side neuromuscular and muscular performance deficits in at least one lower body extremity exercise movement and at least one upper body extremity exercise movement, a healthy athlete/subject, the trainer/coach is able to determine objectively specific and exact muscular performance problems and exact neuromuscular and muscular performance problems or deficiencies, which, if improved, will enhance the athlete/subject's performance in a sport.

The neuromuscular and muscular performance tests may be split into tests such as: isometric tests, coordination tests, proprioception tests, endurance capacity tests, and strength capacity tests. Each arm or leg is tested individually for overall neuromuscular and muscular performance and then compared to the other arm or leg to compute any deficiency from side-to-side. Lower extremity test procedures may be performed on the squat and side lying glut exercise movements, which are common exercise movements. Upper extremity test procedures may be performed on the latissimus dorsi, chest press, row, lift, and chop exercise movements, which are also common exercise movements. Other exercise movements may also be tested if a particular sport incorporates a different movement not covered by the listed exercises. Once the trainer/coach has the measured results of the test procedures performed on the selected combination of upper and lower extremity exercise movements, the trainer/coach may analyze the results to determine the general neuromuscular and muscular performance and side-to-side neuromuscular and muscular performance deficits. After analyzing the results, the trainer/coach may then create a physical fitness regimen customized for the athlete/subject that is designed to improve the deficient areas found in the analysis of the test results. Muscular performance includes both muscle strength and neuromuscular response as well as any other performance criteria that may be attributed to the tested neuromuscular system. Equipment that is capable of making the measurements required for the sports training methods described herein can be obtained from, for example, Monitored Rehab Systems, B.V., of Claes Tillyweg 2, 2031 Harlem, The Netherlands (sometimes referred to as "MRS equipment"), and example measurements and print-outs described below were obtained with such MRS equipment.

FIG. 1 is a listing 100 of example testing procedures and associated results for testing of the lower extremities using, for example, the Monitored Rehab System (MRS) equipment. The testing protocol for the lower extremities might include, for example, a five second isometric test 102, a ten second isometric test 104, a coordination test 106, a proprioceptive test, an endurance capacity test 110, and a strength capacity test 112. The specific parameters measured or acquired for each test are listed in items 114 to 154.

The isometric tests 102, 104 are performed in the exercise movements by performing the exercise movement against a fixed, unmovable block to quantify the maximum force the affected muscle group is capable of exerting. The rehabilitation equipment measures the force exerted against the fixed, unmovable block. The five second isometric test 102 measures the explosive force of the tested muscle group and is applicable to nearly all sports since most endurance sports include an explosive element, particularly when sprinting. The ten second isometric test 104 would typically be used for endurance sports such as bicycling, running, and swimming. Explosive sports that exert the muscles in bursts of less than ten seconds before a rest period may not need to employ the ten second isometric test. Examples of explosive sports include football, baseball, and many field events from track and field. The MRS rehabilitation equipment limits the tests to durations of one, two, three, four, five, six, and ten seconds. The five second interval was chosen for explosive isometric testing and the ten second interval was chosen for endurance isometric testing. If available, shorter times as low as one second may be useful for explosive isometric testing. Slightly longer times up to six seconds may also be useful for the explosive isometric testing. For the endurance isometric testing, shorter times down to seven seconds may be useful. As desired, longer times, perhaps up to thirty seconds, may also be useful for the endurance isometric testing. For both the five second 102 and ten second 104 isometric tests, the maximum force 114, 118 and the average force 116, 120 test results are analyzed to determine the neuromuscular and muscular performance, as described in more detail below.

The coordination test 106 is performed to evaluate the coordination of the muscle group when performing varying degrees of concentric and eccentric actions with the muscle group. Concentric actions involve a shortening contraction of the muscle and are typically what is thought of as the primary force production portion of an exercise movement. Eccentric actions involve lengthening the muscle and are typically what is thought of as the force reduction portion of an exercise movement. It has been shown that many injuries occur during eccentric muscle action, therefore it is important that both the concentric and eccentric muscle actions are properly evaluated and that the physical fitness regimen addresses both the concentric and eccentric training of the muscle group. The coordination test 106 also evaluates the ability of the muscle group to switch from concentric to eccentric movement. On the MRS rehabilitation equipment, the coordination test 106 is performed by having the athlete/subject perform concentric and eccentric actions of the muscle group to keep a target on a screen on a line that runs the athlete/subject through a series of movement cycles. The coordination test 106 uses a mass setting of a certain weight or mass for a certain period of time, for example, fifteen kilograms for a time period of sixty seconds. The mass of, for example, fifteen kilograms can also used for upper extremity testing as the fifteen kilogram setting on the MRS rehabilitation equipment works well for both the lower extremities on the MRS squat machine and for the upper extremities on the cable column machine. A different mass setting may be chosen, but a range of ten to twenty kilograms is recommended. A different time interval may also be chosen, but a range of forty-five to eighty seconds is recommended. If a different MRS machine is chosen to test a muscle group, a different mass value may be chosen. If non-MRS rehabilitation equipment is chosen, resistance equal to the resistance experienced on the MRS rehabilitation equipment with the above mass settings should be chosen. Other equipment may include settings in force (i.e., pounds) instead of mass (i.e., kilograms), but as long as the resistance experienced by the athlete/subject is in the same range as that experienced on the MRS rehabilitation equipment, the testing may still be properly performed. For the coordination test 106, the concentric percent of correct position 122 and the eccentric percent of correct position 124 test results indicate the neuromuscular and muscular performance and can be used in an analysis or evaluation of such performance.

The proprioception test 108 is performed to evaluate the ability of a muscle group to hold a position with resistance and the ability to return to that position by using muscle memory. On the MRS rehabilitation equipment, the proprioception test 108 is performed by having the athlete/subject rest the muscle group then come to a nearly full final position and keep the nearly full final position, which may be indicated visually, on a guideline of the equipment for a period of three to fifteen seconds, return to rest for five, seven, or ten seconds, and repeat. The last half of the proprioception test 108 removes the visual guide to evaluate the muscle memory of the muscle group. The proprioception test 108 uses a mass setting of, for example, fifteen kilograms for a time period of, for example, sixty seconds. The rest period can be, for example, five seconds and the nearly full final position period can be, for example, ten seconds. It is possible to perform the proprioception test 108 using any of the three to ten second interval settings for the rest period or any of the three to fifteen second interval settings for the nearly full final position period. The rest and nearly full final position should be repeated four times for a total of sixty seconds in the above identified example. A different number of repetitions of the cycle may be used, but a range of two to six repetitions is recommended. The mass of, for example, fifteen kilograms can also be used for upper extremity testing as the fifteen kilogram setting on the MRS rehabilitation equipment works well for both the lower extremities on the MRS squat machine and for the upper extremities on the cable column machine. A different mass setting may be chosen, but a range of ten to twenty kilograms is recommended. A different time interval may be chosen, but a range of forty-five to eighty seconds is recommended. If a different MRS machine is chosen to test a muscle group, a different mass value may be chosen. If non-MRS rehabilitation equipment is chosen, resistance equal to the resistance experienced on the MRS rehabilitation equipment with the above mass settings should be chosen. Other equipment may include settings in force (i.e., pounds) instead of mass (i.e., kilograms), but as long as the resistance experienced by the athlete/subject is in the same range as that experienced on the MRS rehabilitation equipment, the testing may still be properly performed. For the proprioception test 108, the deviation from the correct position 126 test result is analyzed to determine the neuromuscular and muscular performance.

The endurance capacity test 110 is performed to evaluate the endurance strength of the tested muscle group. The endurance capacity test 110 comprises, for example, twenty to thirty repetitions at a mass of twenty-five kilograms on the MRS rehabilitation equipment. The mass of twenty-five kilograms can also be used for upper extremity testing as the twenty-five kilogram setting on the MRS rehabilitation equipment works well for both the lower extremities on the MRS squat machine and for the upper extremities on the cable column machine. A different mass setting may be chosen, but a range of fifteen to forty kilograms is recommended. For explosive sports, such as football, the test might comprise, for example, twenty repetitions. A different number of repetitions may be chosen, but a range of ten to thirty repetitions is recommended for explosive sports. For an endurance sport such as bicycling, the test might comprise, for example, thirty repetitions. Again, a different number of repetitions may be chosen, but a range of twenty to forty repetitions is recommended for endurance sports. If a different MRS machine is chosen to test a muscle group, a different mass value may be chosen. If non-MRS rehabilitation equipment is chosen, resistance equal to the resistance experienced on the MRS rehabilitation equipment with the above mass settings should be chosen. Other equipment may include settings in force (i.e., pounds) instead of mass (i.e., kilograms), but as long as the resistance experienced by the athlete/subject is in the same range as that experienced on the MRS machines, the testing may still be properly performed. For the endurance capacity test 110, both the concentric action 128 and the eccentric action 136 results for peak force 130, 138; maximum speed 132, 140; and total work 134, 142 are analyzed to determine the neuromuscular and muscular performance.

The strength capacity test 112 is performed to evaluate the strength capacity of the tested muscle group. The strength capacity test 112 is similar to the endurance capacity test 110, but it can be with fewer repetitions and/or at a higher mass/weight setting. The strength capacity test 112 comprises, for example, of ten repetitions at a mass of forty kilograms on the MRS rehabilitation equipment. The mass of forty kilograms can also used for upper extremity testing as the forty kilogram setting on the MRS rehabilitation equipment works well for both the lower extremities on the MRS squat machine and for the upper extremities on the cable column machine. A different mass setting may be chosen, but a range of twenty-five to sixty kilograms is recommended. Both explosive sports and endurance sports would perform, for example, ten repetitions using the chosen mass setting. A different number of repetitions may be chosen, but a range of five to fifteen repetitions is recommended. If a different MRS machine is chosen to test a muscle group, a different mass value may be chosen. If non-MRS rehabilitation equipment is chosen, resistance equal to the resistance experienced on the MRS rehabilitation equipment with the above mass settings should be chosen. Other equipment may include settings in force (i.e., pounds) instead of mass (i.e., kilograms), but as long as the resistance experienced by the athlete/subject is in the same range as that experienced on the MRS rehabilitation equipment, the testing may still be properly performed. For the strength capacity test 112, both the concentric action 144 and the eccentric action 150 results for peak force 146, 152 and average watts 148, 154 are analyzed to determine the neuromuscular and muscular performance.

FIG. 2 is a listing 200 of example testing procedures and associated results for testing of the upper extremities using the MRS equipment. The testing for the upper extremities is similar in concept to the testing described for the lower extremities except that the upper extremities use different exercise movements for the test procedures. For the MRS rehabilitation equipment, some of the potential upper extremity exercise movements include latissimus dorsi, chest press, row, lift, and chop. Due to problems with inaccurate readings and/or potential damage to the MRS rehabilitation equipment from a healthy athlete/subject using the equipment, the isometric tests for the upper extremities does not have to be tested. If the equipment were capable of handling the stresses of the test, the tests may be performed to add additional and useful data to the test results. Thus, the upper extremity test procedures include, for example, a coordination test 206, a proprioception test 208, an endurance capacity test 210, and a strength capacity test 212. The times, mass settings, and repetitions for the lower extremity testing also applies to the upper extremity testing. As with the lower extremity testing, for the coordination test 206, the concentric percent of correct position 222 and the eccentric percent of correct position 224 test results are indicative of the neuromuscular and muscular performance. For the proprioception test 208, the deviation from the correct position 226 test result is indicative of the neuromuscular and muscular performance. For the endurance capacity test 210, both the concentric action 228 and the eccentric action 236 results for peak force 230, 238; maximum speed 232, 240; and total work 234, 242 are indicative of the neuromuscular and muscular performance. For the strength capacity test 212, both the concentric action 244 and the eccentric action 250 results for peak force 246, 252 and average watts 248, 254 are indicative of the neuromuscular and muscular performance. These parameters and results can be used to analyze overall and specific performance capabilities, deficiencies, and margins for improvement.

All of the test procedures are performed on one arm or leg at a time to permit testing, comparison, and evaluation of the neuromuscular and muscular performance between the right and left side of the body. There may be some instances where double leg or double arm tests are performed to evaluate a particular sport position and/or if there is some neuromuscular and muscular deficiency that necessitates doing double arm/leg exercise movements to avoid injury. It is also recommended that the settings remain consistent between athletes/subjects no matter which repetition, mass/weight setting, and time settings are chosen. Using consistent settings between athletes/subjects permits comparisons between different athletes/subjects for further analysis purposes. The testing protocol disclosed with respect to FIGS. 1 and 2 may be loaded onto the computer working with the rehabilitation equipment so the athlete/subject testing may be easily performed by simply choosing to do the athlete/subject testing and having the equipment guide the user through the testing process. The MRS rehabilitation equipment is especially well suited to permitting this type of interaction as all of the equipment is capable of being monitored and interacting with a computer system and there would only need to be minor software changes to implement the listed testing protocols as is within the capabilities of persons skilled in the art.

FIG. 3 is a listing 300 of the potential exercise movements for the upper and lower extremities using the MRS equipment. For the lower extremities, there are the squat 302 and the side lying glut 304 exercise movements. For the upper extremities, there are the latissimus dorsi 306, chest press 308, row 310, lift 312, and chop 314 exercise movements. Each of the exercise movements listed 300 can be performed for the complete list of test procedures disclosed with respect to FIGS. 1 and 2. On the MRS rehabilitation equipment, the lower extremity exercise movements are performed using the MRS squat machine and the upper extremity exercise movements are performed using the MRS cable column machine. Different MRS and non-MRS machines may be chosen, but the mass settings, repetitions, and/or the time intervals may need to be adjusted to accommodate the differences between the selected rehabilitation equipment.

FIG. 4 is a listing 400 of examples of decision criteria for the creation of a physical fitness regimen for an athlete/subject based on the results of testing with the MRS equipment. Once the athlete/subject has been tested on the rehabilitation equipment, a physical fitness regimen can be created for the athlete/subject. To create the physical fitness regimen for the athlete/subject based on the testing procedures, the areas of neuromuscular and muscular performance deficiencies are determined by analyzing the MRS tests 402. An optional Functional Movement Screen (FMS) similar to or the same as the mobility and stability screen described by Gray Cook as mentioned above may also be performed supplemental evaluation of the athlete/subject, especially relating to mobility and stability factors. If the functional movement screen is performed, the results of the screen are also analyzed in 402. The results of the analysis 402 are compared to the sporting event requirements (e.g., the NASM sports specific functional tests) to evaluate the performance of the athlete/subject for the desired sport 404. The MRS test results are reviewed and anything with a deficit from side-to-side of more than a high deficit threshold, for example, ten percent, is flagged as indicating that corrective exercises need to be given as part of the physical fitness regimen to correct the deficit 406. In some instances, lower deficits such as five percent may indicate a need for corrective exercises depending on the sensitivity and competitive class of the athlete/subject. If performed, the functional movement screen results are reviewed to determine overall mobility and stability 408. If deficiencies are found in the functional movement screen, corrective exercises are included in the physical fitness regimen designed for the athlete/subject. All of the analysis is reviewed and a physical fitness training regimen is designed in order to give the athlete/subject a balanced body 410. Retesting is performed to continually evaluate the progress of the athlete/subject 412. Typical retest times are four, six, eight, or twelve weeks, but other retest intervals may also be used. The fitness training regimen may be increased as indicated by the results of retests and the progress of the athlete/subject 414.

FIG. 5 is a listing 500 of example exercise movements to test an athlete/subject on with the MRS equipment for specific desired sports. The testing protocol may be changed to accommodate the needs of different sports. For instance, bicycling 502 uses a lot of latissimus muscle movement in the upper body as the bicyclist 502 moves up and down when pedaling the bike. Bicycling 502, however, does not use a lot of upper body rotational movement like baseball 504. Thus, the testing protocol for a bicyclist 502 would include the latissimus dorsi upper extremity exercise movement while the testing protocol for a baseball player 504 would include the lift and chop exercises upper extremity exercise movements to address the rotational aspects of baseball 504. The recommended exercise movements to test for a bicyclist 502 are the squat and the latissimus dorsi. The same testing done for a bicyclist may also be performed for a runner since the bicyclist and the runner share many of the same muscle movement criteria. A bicyclist may also use the stationary bike to evaluate the performance of the cyclist since many of the stationary bikes and bike stands provide a great deal of information on the speed, force, power, and work output of the rider. The recommended exercise movements to test for a baseball player 504 are the squat, side lying glut, and the lift and chop exercise movements. The recommended exercise movements to test for a football player 506 are the squat, side lying gluteus, and the chest press and row exercise movements. The recommended exercise movements to test for a soccer player 508 are the squat, the side lying gluteus, the chest press and row, and the latissimus dorsi exercise movements. If an evaluation of a sport indicates that additional testing should be performed, other exercise movements may be added to the testing protocol for the above listed sports 502, 504, 506, 508. Additional sports may also be added if evaluation is desired for new sports 510. To add a testing protocol for new sport, the needs of the sport will need to be evaluated against the available exercise movements, and a list of exercise movements may be chosen to accommodate the needs of the desired sport. Some possible new sports that may be evaluated include: hockey, figure skating, swimming, running, and many other sports.

FIG. 6 is a printout of the results for an example five second isometric test 602 using the MRS rehabilitation equipment. Since the MRS equipment is designed for rehabilitation, the data is listed for the involved (injured) side 606 and the non-involved side 604. For sport testing of healthy athletes/subjects, it is appropriate to just assign the "involved" and "uninvolved" sides to "left" and "right" or vice versa. To maintain a standard for a healthy subject not using the MRS equipment for rehabilitation, for example, it is convenient for the non-involved side to be chosen to be the right side 604 and the involved side is chosen to be the left side 606. The test results for each side 604, 606 are listed in the appropriate column. The deficit, or difference, in performance between the left 606 and right 604 sides is shown in the deficit column 608. The deficit values 608 are important for the evaluation of balance between the right 604 and left 606 side muscle groups. The maximum force 610 and the average force 612 are the primary test results used to evaluate the athlete/subject to create the physical fitness regimen. Both the maximum force and average force are measured in Newtons (N). A graph 614 also shows the performance of each muscle group in graphical format for further evaluation.

Figure 7:
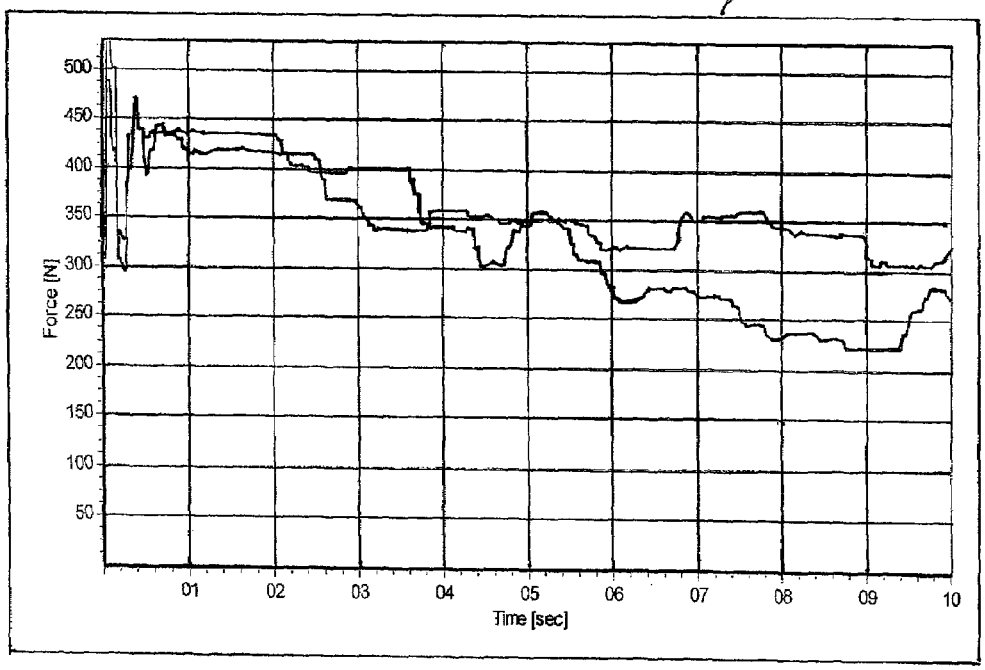
FIG. 7 is an example printout of results for a ten second isometric test using the MRS rehabilitation equipment.

FIG. 7 is a printout of the results for an example ten second isometric test 702 using the MRS rehabilitation equipment. The description of the result printout for such a ten second isometric test 702 is nearly identical to the description with respect to FIG. 6 for a five second isometric test. As is apparent from the title, the ten second isometric test 702 lasts ten seconds while the five second isometric test 602 lasts only five seconds. Since the MRS equipment is designed for rehabilitation, the data is listed for the involved (injured) side 706 and the non-involved side 704. To maintain a standard for a healthy subject not using the MRS equipment for rehabilitation, the non-involved side is chosen to be the right side 704 and the involved side is chosen to be the left side 706. The test results for each side 704, 706 are listed in the appropriate column. The deficit, or difference, in performance between the left 706 and right 704 sides is shown in the deficit column 708. The deficit values 708 are important for the evaluation of balance between the right 704 and left 706 side muscle groups. The maximum force 710 and the average force 712 are the primary test results used to evaluate the athlete/subject to create the physical fitness regimen. Both the maximum force and average force are measured in Newtons (N). A graph 714 also shows the performance of each muscle group in graphical format for further evaluation.

Figure 8:
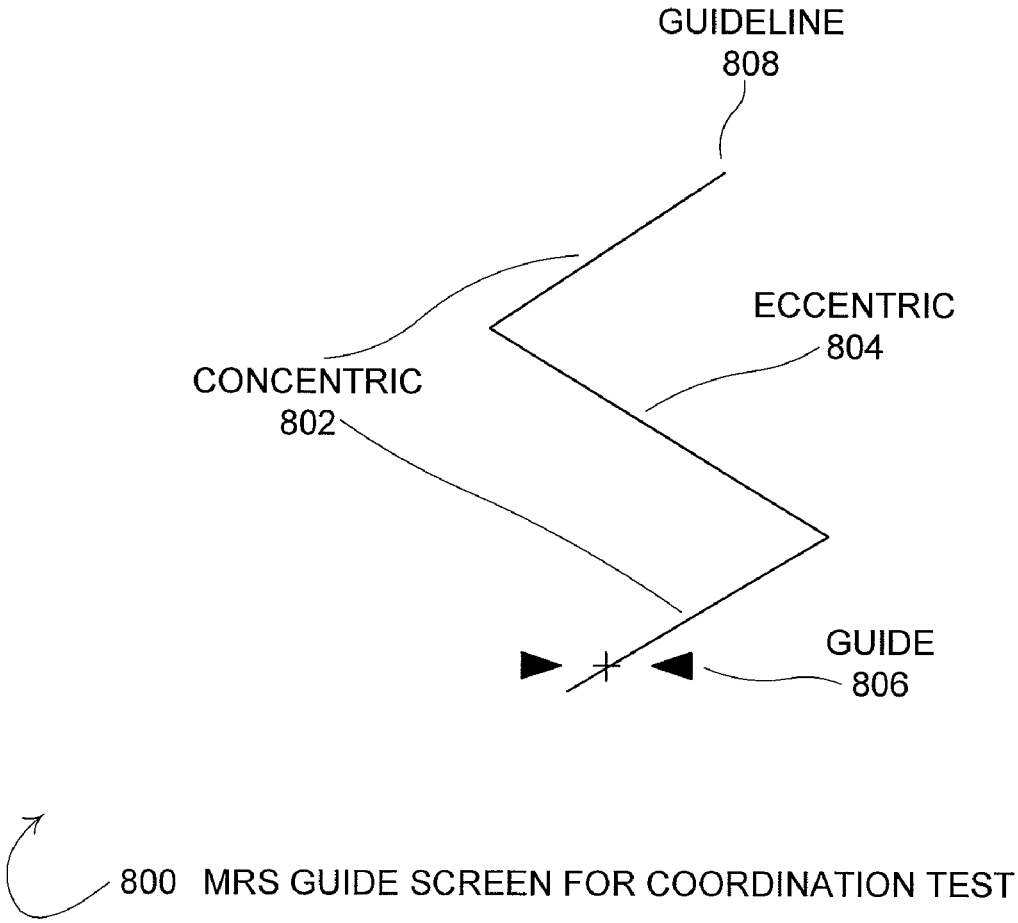
FIG. 8 is a schematic illustration of an example guide screen for a coordination test on the MRS rehabilitation equipment.

FIG. 8 is schematic illustration 800 of an example guide screen for a coordination test on the MRS rehabilitation equipment. Essentially, there is a functional connection or relationship between the position of the handle, foot plate, or other piece being grasped or moved by the athlete/subject and the cursor or guide 806 on the monitor or display. The MRS equipment has this functionality, so it is not necessary to describe how it is actually accomplished. The athlete/subject attempts to keep the guide 806 on the guideline 808 as the guideline 808 progresses down the screen toward the guide 806 by shortening (concentric 802) or lengthening (eccentric 804) the muscle to position the weight, handle, or foot plate in a manner that controls the cursor or guide 806 in the desired positions. During the coordination test, the guideline 808 changes positions on the monitor or display at various intervals between concentric 802 and eccentric stages to test the coordination of the muscle group. The angle of the guideline 808 on the monitor or display also changes to simulate fast or slow concentric 802 and eccentric 804 movement, and the athlete/subject attempts to position the weight, handle, foot plate, or other piece being grasped in a manner that maintains the cursor or guide 806 centered on the guideline 808. The measured results indicate the athlete/subject's ability to do so.

FIG. 9 is a printout of the results for an example coordination test 902 using the MRS rehabilitation equipment. Again, since the MRS equipment is designed for rehabilitation, the data is listed for the involved (injured) side 906 and the non-involved side 904. To maintain a standard for a healthy subject not using the MRS equipment for rehabilitation, the non-involved side is chosen to be the right side 904 and the involved side is chosen to be the left side 906. The test results for each side 904, 906 are listed in the appropriate column. The deficit, or difference, in performance between the left 906 and right 904 sides is shown in the deficit column 908. The deficit values 908 are important for the evaluation of balance between the right and left side muscle groups. The coordination test results 902 separates values into the concentric action (i.e., shortening) 910 and the eccentric action (i.e., lengthening) 914. Separating the concentric 910 results from the eccentric 914 results permits an evaluation of both the primary shortening action as well as the lengthening action that is valuable for sports related physical fitness. For both the concentric 910 and eccentric 914 test results, the primary test results used to evaluate the athlete/subject is the correct position 912, 916 measured as a percentage of time the guide 806 was properly on the guideline 808 as explained above. A concentric graph 918 and eccentric graph 926 display a bar graph that shows the amount of time spent at certain distance ranges from the desired guideline. For both the concentric graph 918 and the eccentric graph 926, it is desired that the graph results are predominantly in the middle of the graph 922, 930 indicating little variation from the guideline. Outlying results 920, 924, 928, 932 indicate that the athlete/subject was not able to keep the guide on the guideline.

Figure 10:
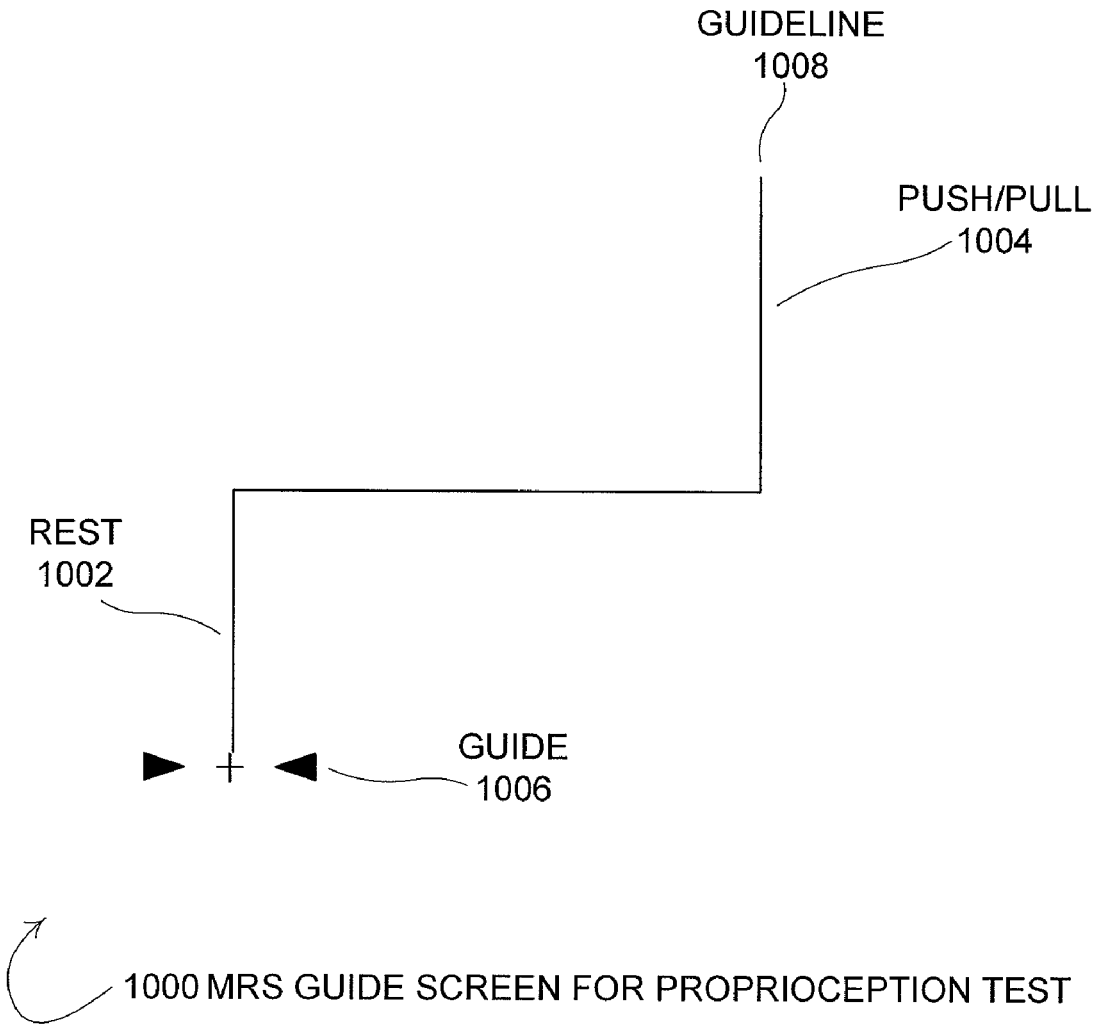
FIG. 10 is a schematic illustration of an example guide screen for a proprioception test on the MRS rehabilitation equipment.

FIG. 10 is a schematic illustration 1000 of an example guide screen for a proprioception test on the MRS rehabilitation equipment. The athlete/subject attempts to position the weight, handle, foot plate, or other piece being grasped or moved in a manner that maintains the guide 1006 on the guideline 1008 as the guideline 1008 progresses down the screen toward the guide 1006. For the proprioception test, the guideline 1008 is either with the muscles at rest 1002 or holding the weight, handle, foot plate, or other piece being grasped or moved at a near full final stage position. The guideline 1008 does not extend to the full final stage position, because the proprioception test intends to measure muscle reaction and does not want the joint to lock out during the test. As discussed in the description with respect to FIGS. 2 and 3, the proprioception test alternates between rest periods and near full final position periods. To avoid unintended deviation time of the guide 1006 from the guideline 1008, the athlete/subject may be permitted to begin the push/pull to get to the near full final position guideline before the rest period is complete, for example, any time after the rest period is seventy percent complete. The MRS rehabilitation equipment permits other settings for the percentage of time permitted to reach the nearly full final position, but it is recommended that the percentage of time be between seventy and ninety percent of the rest period being complete before beginning to move to the nearly full final position stage. Half-way through the test, the guideline 1008 is removed from the monitor or display, leaving only an indication of when to switch between rest and near full final position in order to test the muscle memory of the muscle group. Much the same thing can be accomplished by removing the guide 1006 instead of the guideline 1008.

FIG. 11 is an example printout of the results for a proprioception test on a right limb 1102 using the MRS rehabilitation equipment. For the proprioception test, there is a result page for each side tested, so there is a separate result page for the right 1102 and left 1202 sides. The results for the proprioception test are given for the non-visible 1108 portion of the test, the visible 1110 portion of the test, and the deficit 1112 between the non-visible 1108 and visible 1110 portions of the test. The deficit, or difference, in performance between the left and right side muscle groups is determined by comparing the result pages of the right side 1102 and left side 1202 test results. A graph 1106 also shows the performance of the tested muscle group in graphical format for further evaluation.

FIG. 12 is an example printout of the results for a proprioception test on a left limb 1202 using the MRS rehabilitation equipment. For the proprioception test, there is a result page for each side tested, so there is a separate result page for the right 1102 and left 1202 sides. The results for the proprioception test are given for the non-visible 1208 portion of the test, the visible 1210 portion of the test, and the deficit 1212 between the non-visible 1208 and visible 1210 portions of the test. The deficit, or difference, in performance between the left and right side muscle groups is determined by comparing the result pages of the right side 1202 and left side 1202 test results. A graph 1206 also shows the performance of the tested muscle group in graphical format for further evaluation.

FIG. 13 is a printout of the results for an example endurance capacity test 1302 on the MRS rehabilitation equipment. Again, since the MRS equipment is designed for rehabilitation, the data is listed for the involved (injured) side 1306 and the non-involved side 1304. To maintain a standard for a healthy subject not using the MRS equipment for rehabilitation, the non-involved side is chosen to be the right side 1304 and the involved side is chosen to be the left side 1306. The endurance capacity test involves, for example, pulling or pushing the mass or weight repetitively deliberate, less than full, speed through the functional range of the muscles. The test results for each side 1304, 1306 are listed in the appropriate column. The deficit, or difference, in performance between the left 1306 and right 1304 sides is shown in the deficit column 1308. The deficit values 1308 are useful for the evaluation of balance between the right 1304 and left 1306 side muscle groups. The endurance capacity test results 1302 separates values into the concentric action (i.e., shortening) 1310 and the eccentric action (i.e., lengthening) 1318. Separating the concentric 1310 results from the eccentric 1318 results permits an evaluation of both the concentric action as well as the eccentric action that is valuable for sports related physical fitness. For both the concentric 1310 and eccentric 1318 test results, the primary test results used to evaluate the athlete/subject are the peak force measured, for example, in Newtons (N) 1312, 1320; the total work measured, for example, in Newton Meters (Nm) 1314, 1322; and the maximum speed measured, for example, in centimeters per second (cm/s) 1316, 1324. A concentric graph 1326 showing each repetition of the concentric stage of the exercise movement in graphical form (force versus distance) and an eccentric graph 1328 showing each repetition of the eccentric stage of the exercise movement in graphical form (force versus distance) are also available for further evaluation of the test results.

FIG. 14 is a printout of the results for an example strength capacity test 1402 on the MRS rehabilitation equipment. The printout of the strength capacity test 702 appears nearly identical to the endurance capacity test shown in FIG. 13. As discussed previously with respect to FIGS. 1 and 2, the purpose, mass settings, and repetitions for the strength capacity test 1402 are different than for the endurance capacity test 1302. As is apparent from the title, the strength capacity test 1402 is intended to evaluate the strength of the muscle group while the endurance capacity test 1302 is intended to evaluate the endurance of the muscle group. The strength capacity test can be performed, for example, much like the endurance capacity test, but at full speed. Again, since the MRS equipment is designed for rehabilitation, the data is listed for the involved (injured) side 1406 and the non-involved side 1404. To maintain a standard for a healthy subject not using the MRS equipment for rehabilitation, the non-involved side is chosen to be the right side 1404 and the involved side is chosen to be the left side 1406. The test results for each side 1404, 1406 are listed in the appropriate column. The deficit, or difference, in performance between the left 1406 and right 1404 sides is shown in the deficit column 1408. The deficit values 1408 are important for the evaluation of balance between the right 1404 and left 1406 side muscle groups. The strength capacity test results 1402 separates values into the concentric action (i.e., shortening) 1410 and the eccentric action (i.e., lengthening) 1416. Separating the concentric 1410 results from the eccentric 1416 results permits an evaluation of both the concentric action as well as the eccentric action that is valuable for sports related physical fitness. For both the concentric 1410 and eccentric 1416 test results, the primary test results used to evaluate the athlete/subject are the peak force measured, for example, in Newtons (N) 1412, 1418 and the average power measured in, for example, Watts (W) 1414, 1420. A concentric graph 1422 showing each repetition of the concentric stage of the exercise movement in graphical form and an eccentric graph 1424 showing each repetition of the eccentric stage of the exercise movement in graphical form are also available for further evaluation of the test results.

For FIGS. 6-14, the test results pages are printouts from an MRS rehabilitation machine. Test results for non-MRS equipment may appear substantially different. All of the test results shown were for the squat exercise movement. Other exercise movements performed on MRS rehabilitation equipment will have result pages that have substantially the same form appearance as the result pages shown for the squat exercise movement. All MRS results are shown with a precision of the nearest whole digit. Both more and less precision in results may be acceptable for various embodiments of the invention. Significantly greater precision down into the decimal places may not be necessary, but it will not impede an embodiment of the invention. Less precision may also be acceptable. Less precision up to plus or minus ten whole digits may also permit a trainer/coach to perform an embodiment of the invention.

Figure 15:
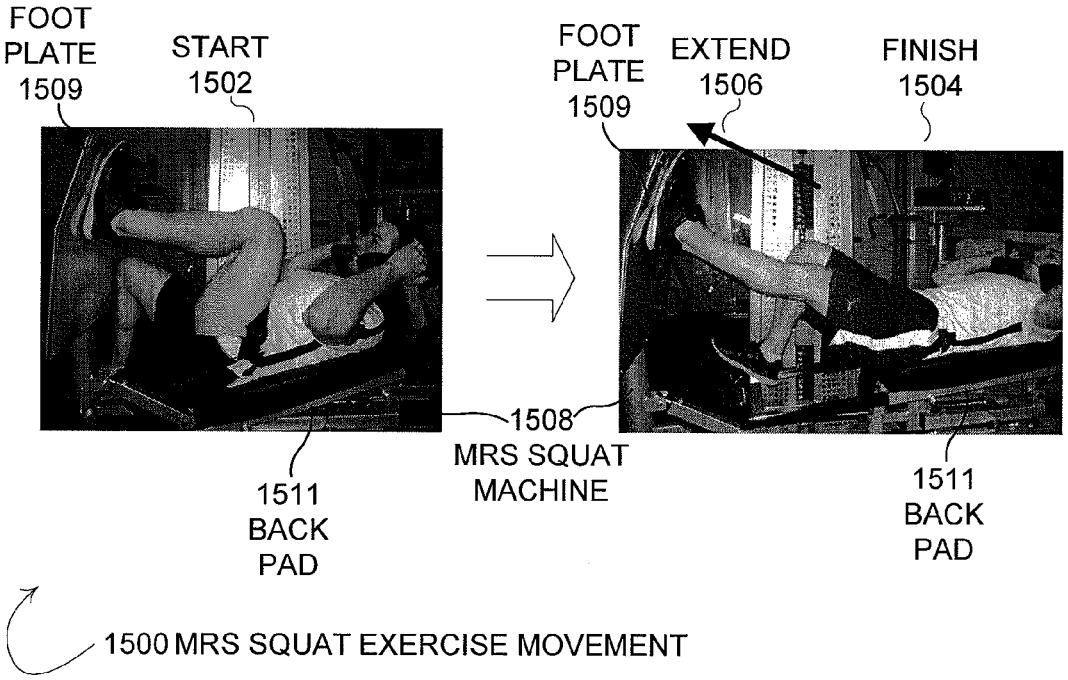
FIG. 15 is an illustration of an example MRS squat exercise movement.

FIG. 15 is an illustration 1500 of an example MRS squat exercise movement. As shown, the squat exercise movement begins at the start position 1502 and ends at the finish position 1504 as the athlete/subject extends the leg 1506 as shown. The MRS squat machine 1508 is also shown in the illustration 1500. The position of the cursor or guide on the monitor or display (not shown) is correlated to the position of the back pad 1511 as the back pad 1511 is moved by the athlete/subject's leg. The foot plate 1509 remains fixed providing a solid surface to exert force against for the athlete/subject. In other embodiments of a squat machine the back pad 1511 may be fixed while the foot pad 1509 is moved by the athlete/subject's leg.

Figure 16:
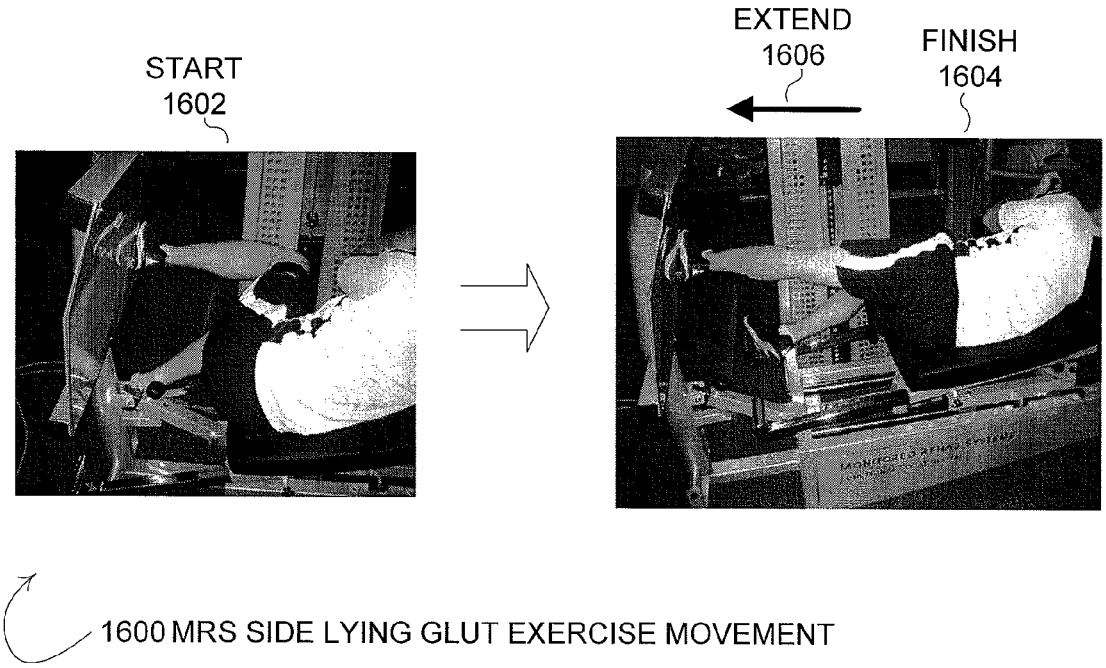
FIG. 16 is an illustration of an example MRS side lying glut exercise movement.

FIG. 16 is an illustration 1600 of an example MRS side lying glut exercise movement. As shown, the side lying glut exercise movement begins at the start position 1602 and ends at the finish position 1604 as the athlete/subject extends the leg 1606 as shown. Again, the position of the cursor or guide on the monitor or display (not shown) is correlated to the position of the back pad as the back pad is moved by the athlete/subject.

Figure 17:
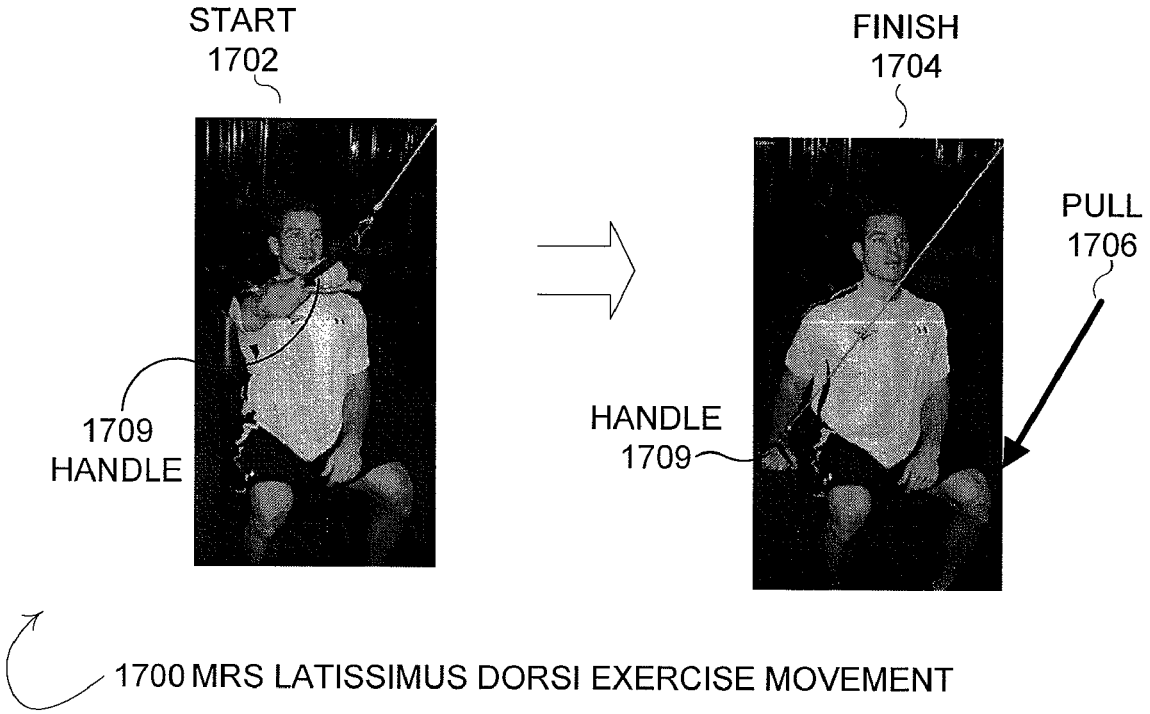
FIG. 17 is an illustration of an example MRS latissimus dorsi exercise movement.

FIG. 17 is an illustration 1700 of an example MRS latissimus dorsi exercise movement. As shown, the latissimus dorsi exercise movement begins at the start position 1702 and ends at the finish position 1704 as the athlete/subject pulls the arm down 1706 as shown. The position of the cursor or guide on the monitor or display (not shown) is correlated to the position of the handle 1709 as the handle 1709 is moved by the athlete/subject's arm.

Figure 18:
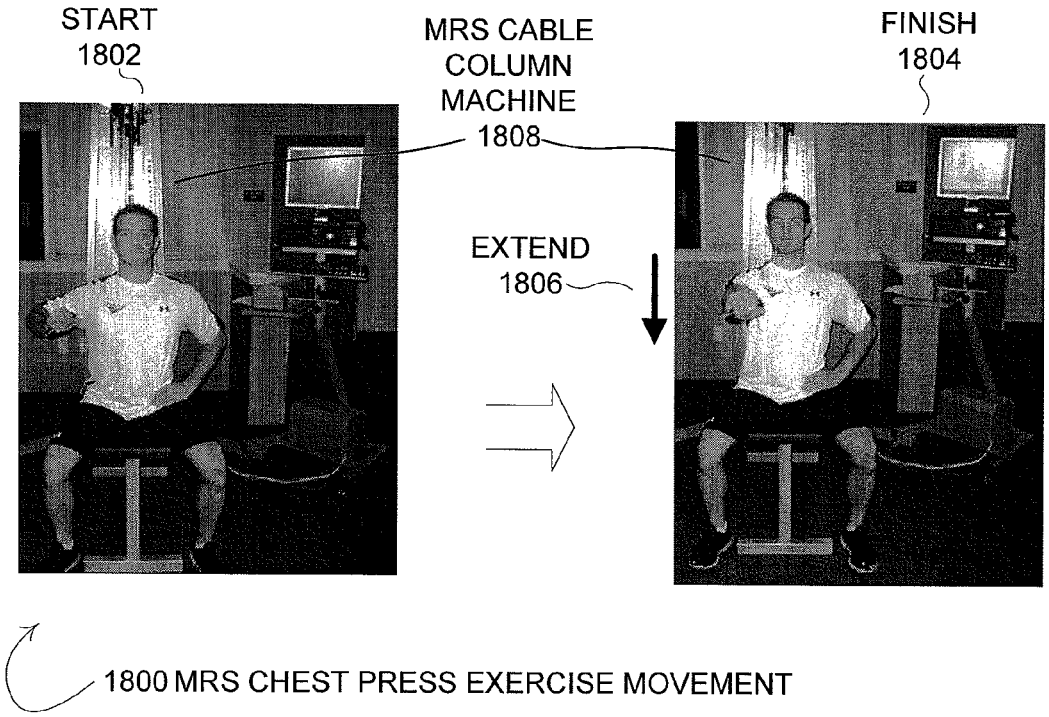
FIG. 18 is an illustration of an example MRS chest press exercise movement.

FIG. 18 is an illustration 1800 of an example MRS chest press exercise movement. As shown, the chest press exercise movement begins at the start position 1802 and ends at the finish position 1804 as the athlete/subject pushes the arm 1806 as shown. The MRS cable column machine 1808 is also shown in the illustration 1800. Again, the position of the cursor or guide on the monitor or display (not shown) is correlated to the position of the handle as the handle is moved by the athlete/subject.

Figure 19:
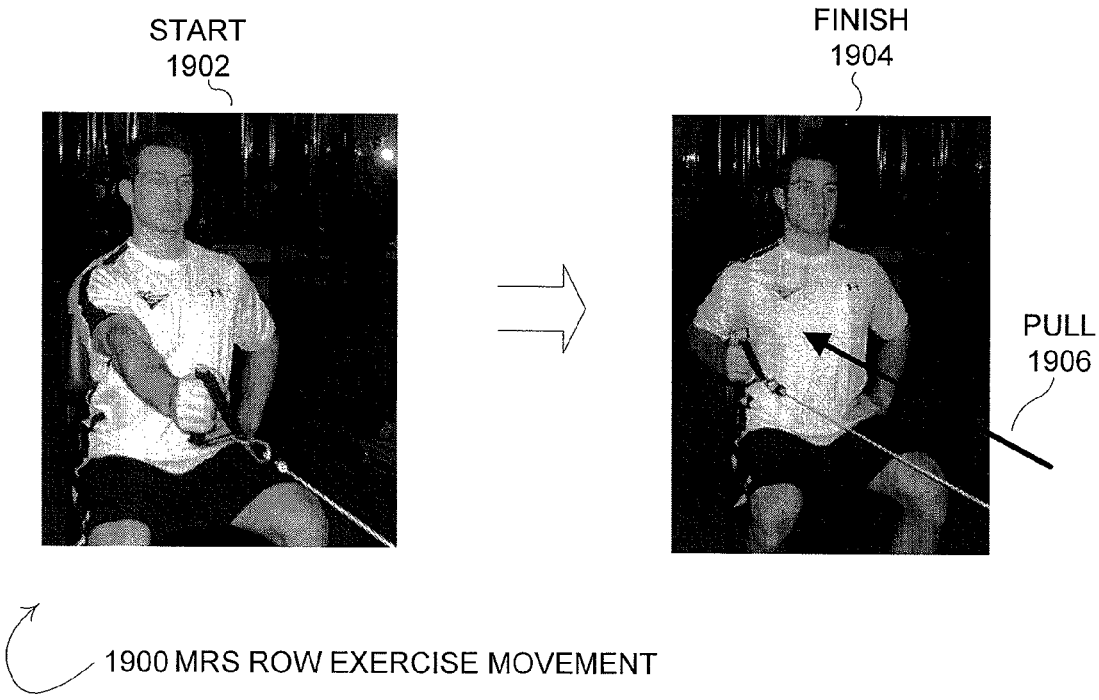
FIG. 19 is an illustration of an example MRS row exercise movement.

FIG. 19 is an illustration 1900 of an example MRS row exercise movement. As shown, the row exercise movement begins at the start position 1902 and ends at the finish position 1904 as the athlete/subject pulls the arm back 1906 as shown. Again, the position of the cursor or guide on the monitor or display (not shown) is correlated to the position of the handle as the handle is moved by the athlete/subject.

Figure 20:
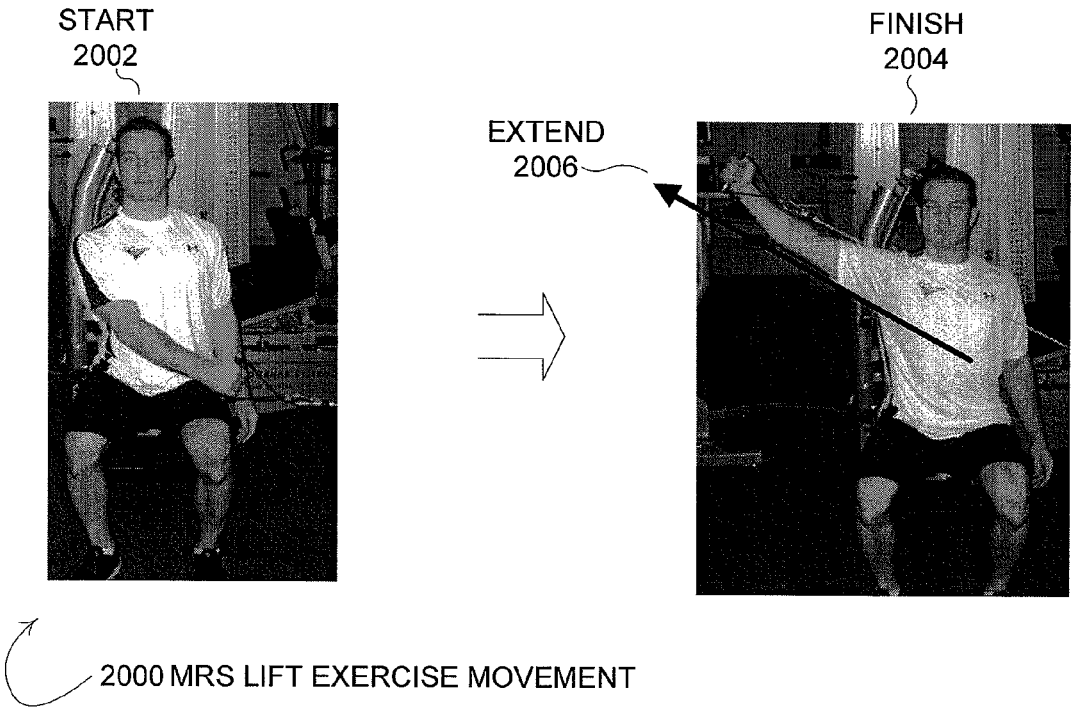
FIG. 20 is an illustration of an example MRS lift exercise movement.

FIG. 20 is an illustration 2000 of an example MRS lift exercise movement. As shown, the lift exercise movement begins at the start position 2002 and ends at the finish position 2004 as the athlete/subject pulls the arm upward across the body 2006 as shown. Again, the position of the cursor or guide on the monitor or display (not shown) is correlated to the position of the handle as the handle is moved by the athlete/subject.

Figure 21:
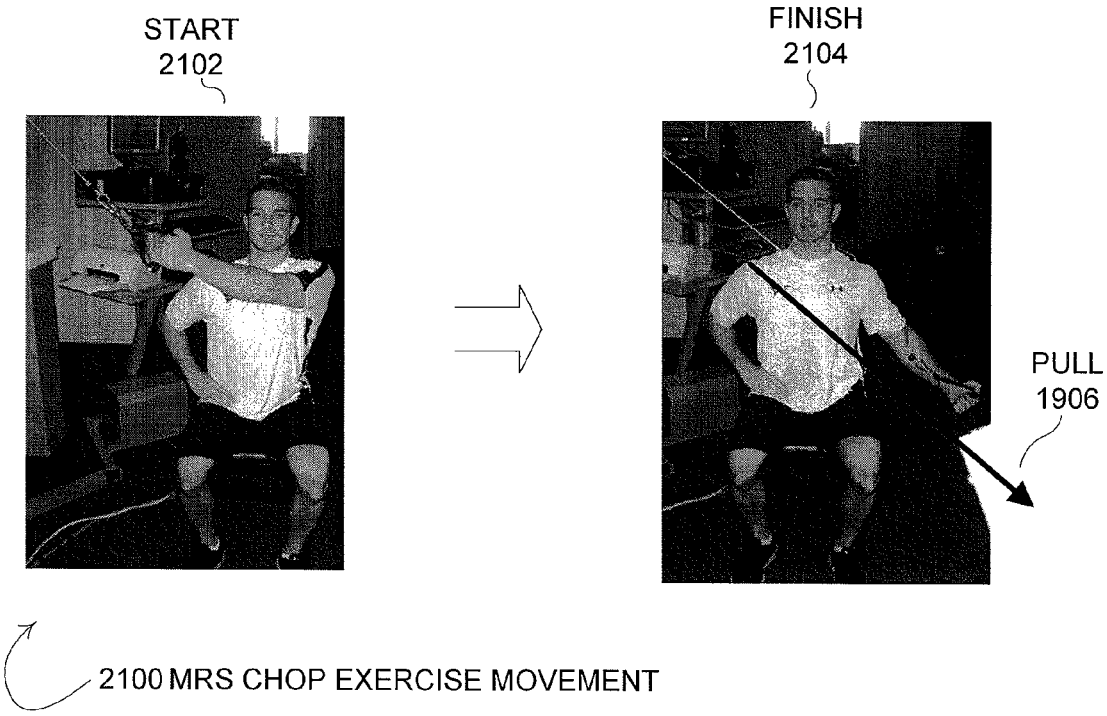
FIG. 21 is an illustration of an example MRS chop exercise movement.

FIG. 21 is an illustration of an example MRS chop exercise movement. As shown, the chop exercise movement begins at the start position 2102 and ends at the finish position 2104 as the athlete/subject pulls the arm downward across the body 2106 as shown. Again, the position of the cursor or guide on the monitor or display (not shown) is correlated to the position of the handle as the handle is moved by the athlete/subject.

The results of the objective tests described above can be used alone or in combination with other tests to evaluate the athlete/subject's neuromuscular and muscular performance and to develop a training regimen to improve athletic performance. FIG. 22 is a listing 2200 of the potential exercise movements for use with a functional movement screen or test (FMS). A functional movement screen or test, such as that developed by Gray Cook and described in his book mentioned above, may be added to the MRS test protocols as an additional set of tests to evaluate the stability and mobility of the athlete/subject, if desired, but they are not necessary. The Functional Movement Screen (FMS) test results can be analyzed in combination with the MRS test results, and the results of the combined analysis may then be used to create a physical fitness regimen for the athlete/subject that incorporates exercises to address deficiencies found in either the MRS test results and/or the functional movement screen test results. The functional movement screen is administered by the trainer/coach without objective measuring equipment, such as the MRS equipment described above. The trainer/coach observes the athlete/subject performing various exercise movements and grades the subject on a scale, for example, from 0 for complete failure to 3 for complete success. Potential exercise movements to include in the functional movement screen include: deep squat 2202, hurdle step 2204, inline lunge 2206, shoulder mobility 2208, active straight leg raise 2210, trunk stability 2212, and rotary stability 2214.

Figure 23:
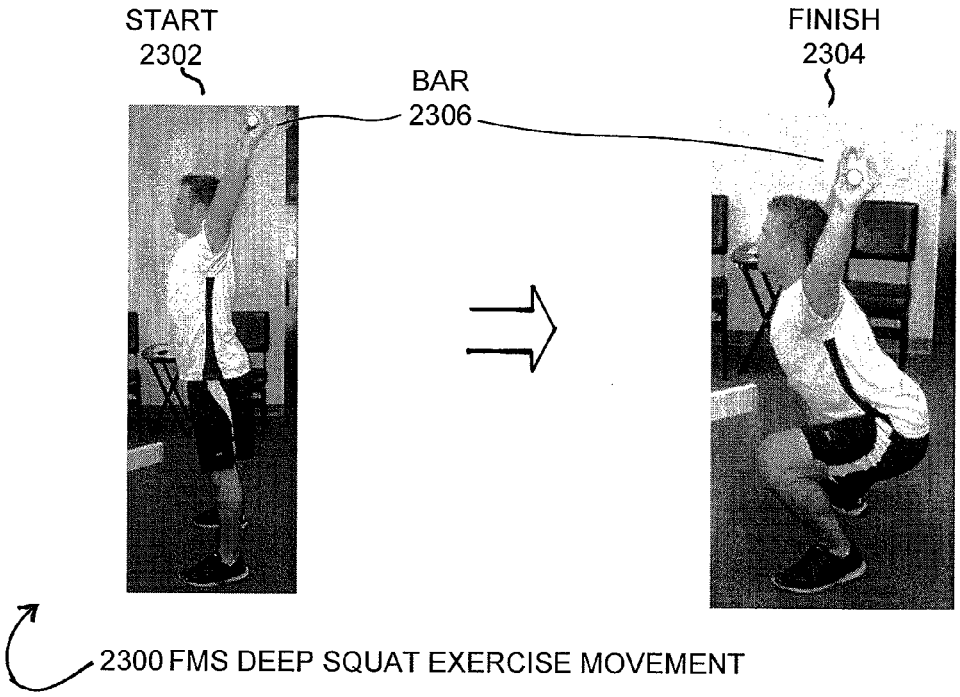
FIG. 23 is an illustration of an example FMS deep squat exercise movement.

FIG. 23 is an illustration 2300 of an example FMS deep squat exercise movement. As shown, the deep squat exercise movement begins at the start position 2302 and ends at the finish position 2304. The athlete/subject holds a bar 2306 over his/her head to emphasis the mobility and stability aspects of the exercise movement.

Figure 24:
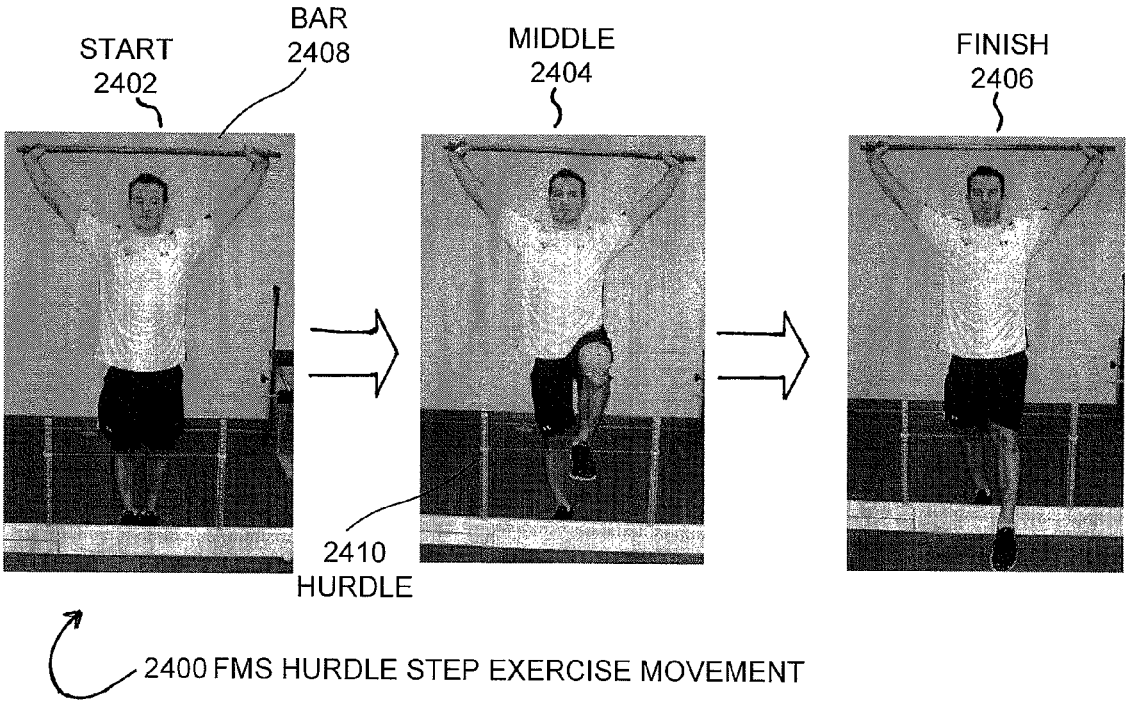
FIG. 24 is an illustration of an example FMS hurdle step exercise movement.

FIG. 24 is an illustration 2400 of an example FMS hurdle step exercise movement. As shown, the hurdle step exercise movement begins at the start position 2402, moves to the middle position 2404 as the athlete/subject steps over the hurdle 2410 and ends at the finish position 2406. The athlete/subject holds a bar 2408 over his/her head to emphasis the mobility and stability aspects of the exercise movement. The hurdle step exercise movement is performed for the right and left legs.

Figure 25:
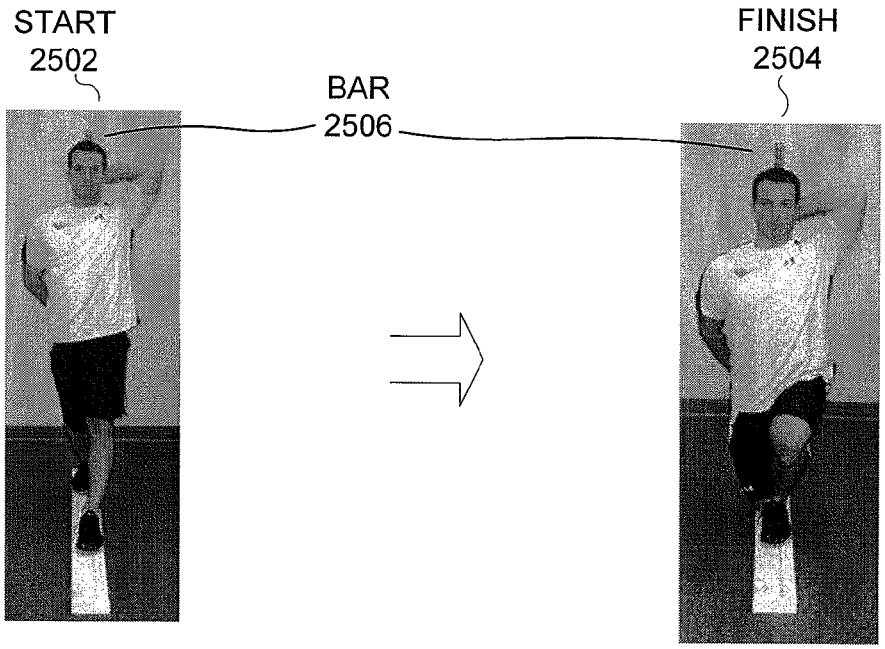
FIG. 25 is an illustration of an example FMS inline lunge exercise movement.

FIG. 25 is an illustration 2500 of an example FMS inline lunge exercise movement. As shown, the inline lunge exercise movement begins at the start position 2502 and ends at the finish position 2504. The athlete/subject holds a bar 2506 behind his/her head to emphasis the mobility and stability aspects of the exercise movement. The inline lunge exercise movement is performed for the right and left legs.

Figure 26:
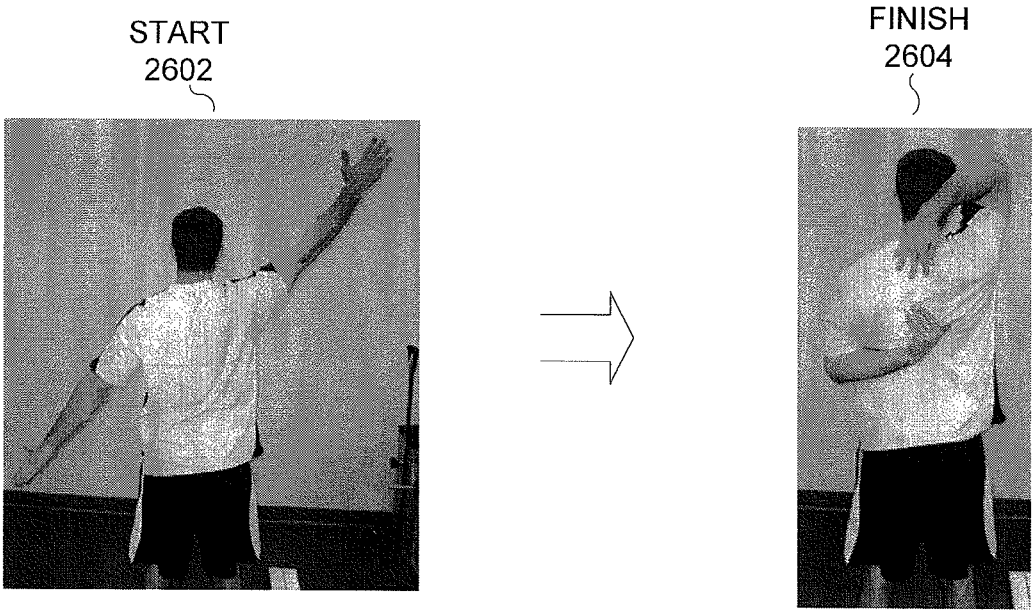
FIG. 26 is an illustration of an example FMS shoulder mobility exercise movement.

FIG. 26 is an illustration 2600 of the FMS shoulder mobility exercise movement. As shown, the shoulder mobility exercise movement begins at the start position 2602 and ends at the finish position 2604. The shoulder mobility exercise movement is performed for the right and left shoulders.

Figure 27:
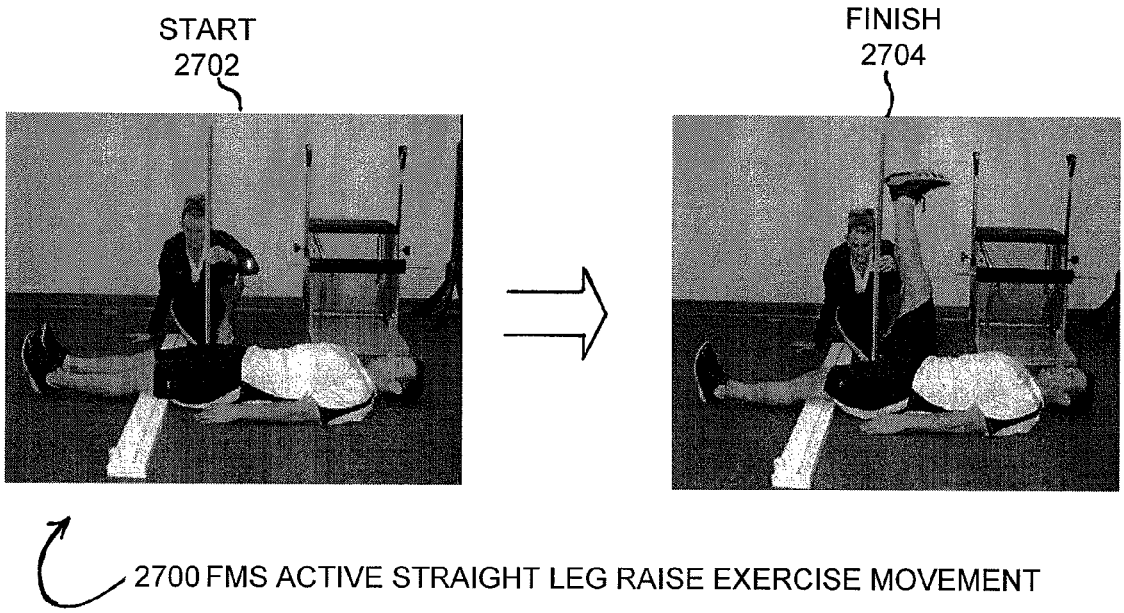
FIG. 27 is an illustration of an example FMS active straight leg raise exercise movement.

FIG. 27 is an illustration 2700 of the FMS active straight leg raise exercise movement. As shown, the active straight leg raise exercise movement begins at the start position 2702 and ends at the finish position 2704. The active straight leg raise exercise movement is performed for the right and left legs.

Figure 28:
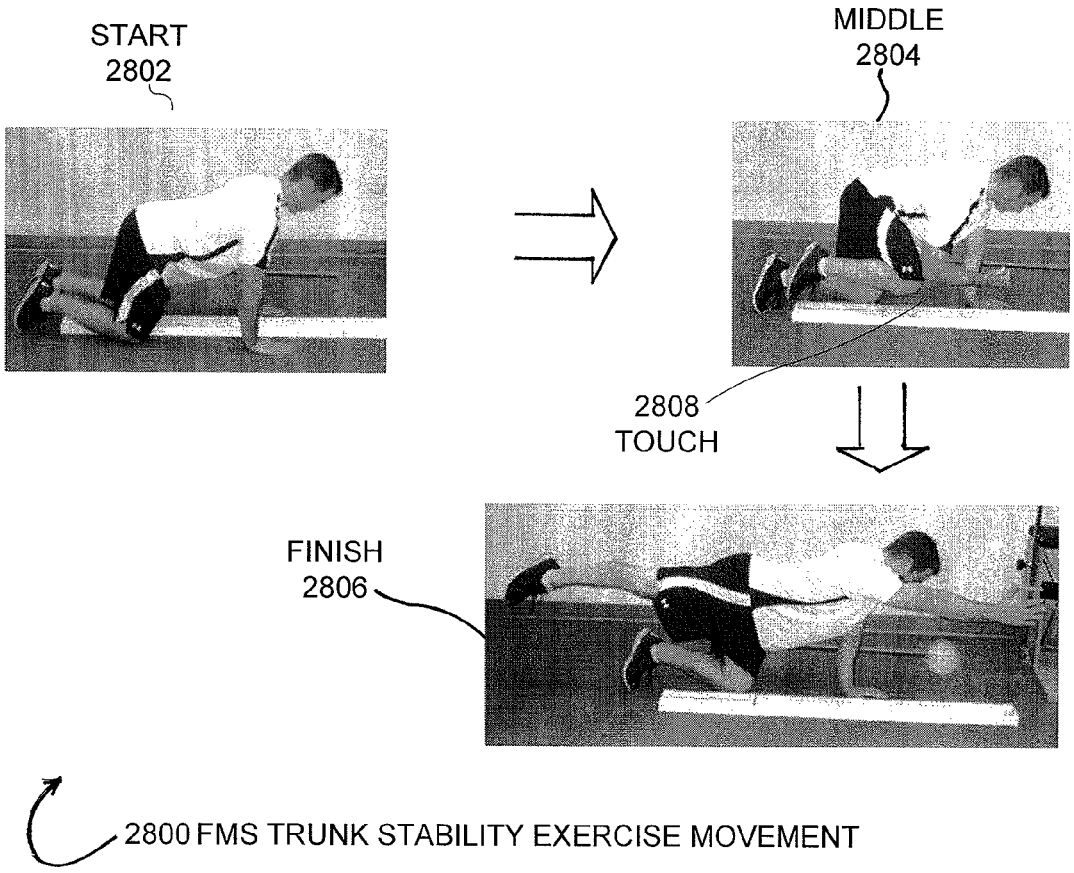
FIG. 28 is an illustration of an example FMS trunk stability exercise movement.

FIG. 28 is an illustration 2800 of the FMS trunk stability exercise movement. As shown, the trunk stability exercise movement begins at the start position 2802, moves to the middle position 2804 as the athlete/subject touches the same-side knee and elbow 2808 and ends at the finish position 2806. The trunk stability exercise is performed for the right and left sides of the body.

Figure 29:
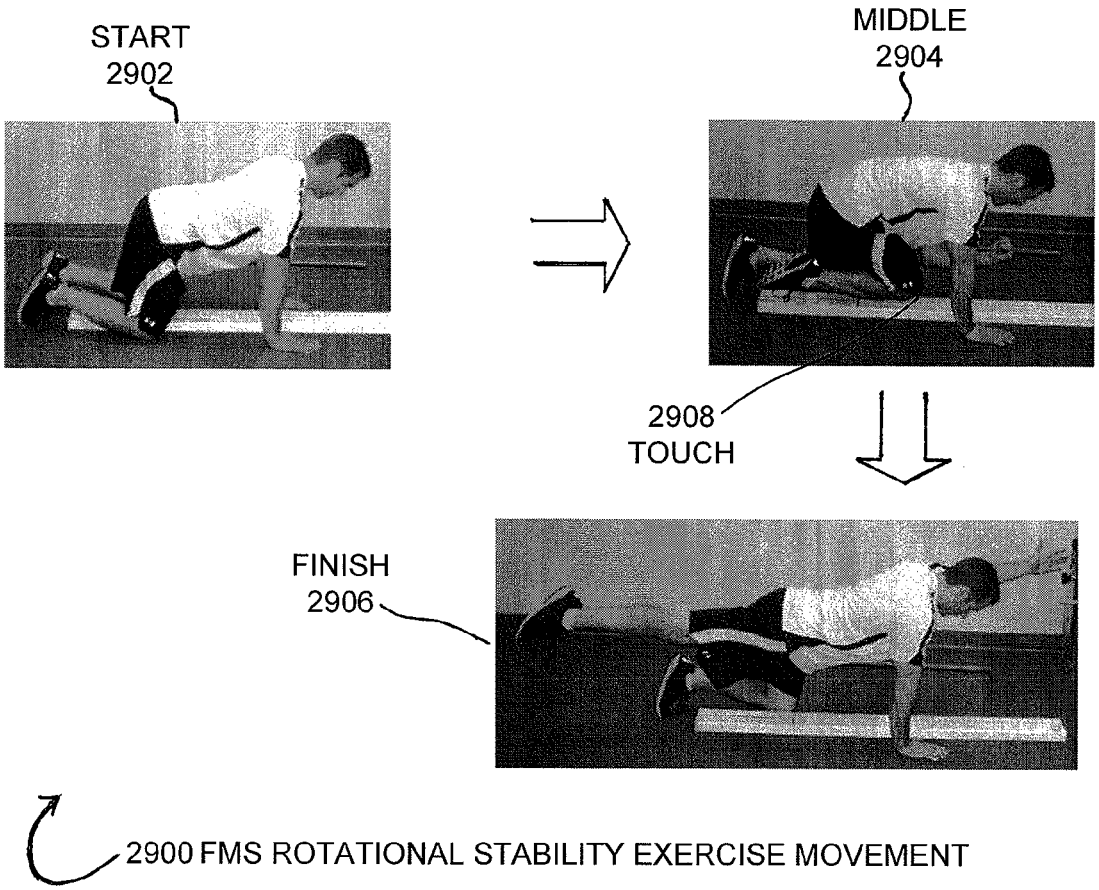
FIG. 29 is an illustration of an example FMS rotational stability exercise movement.

FIG. 29 is an illustration of the FMS rotational stability exercise movement. As shown, the rotational stability exercise movement begins at the start position 2902, moves to the middle position 2904 as the athlete/subject touches the opposite-side knee and elbow 2908 and ends at the finish position

2906. The rotational stability exercise is performed for the right and left arm, and again for left leg and right arm.

FIGS. 30A-J show various pages for a spreadsheet tool that may be provided to a trainer/coach to assist in practicing an embodiment of the invention. The spreadsheet tool may provide some conversions between metric and English units to make the data more readable for a person familiar with English measurement units such as pounds instead of Newtons. The spreadsheet tool may also provide pre-configured summary pages that help present the test data in a condensed format for easier evaluation. The spreadsheet tool may also perform calculations on the test results to help in the analysis of the test results. The spreadsheet tool may contain a form for creating a physical test regimen as well as check off sheets for the athlete/subject to used when working through the physical test regimen. Further, the spreadsheet tool may gather all of the above mentioned data into a single tool for easy presentation and storage. The spreadsheet tool may be provided to a trainer/coach on a electronic storage medium such as a Compact Disc (CD) or a Digital Versatile Disc (DVD). The spreadsheet tool may also be provided via an electronic signal such as a network connection, most likely an Internet connection. Other tools may also be provided with the spreadsheet tool such as user guides and instruction booklets for practicing various embodiments of the invention.

As mentioned above, when the testing is complete, the results can be analyzed and used to create an exercise regimen to enhance athletic performance, including for particular sports. Again, testing can include an isometric test, for example, one or both of the isometric tests 102, 104 in FIG. 1 (the five second isometric test can be included as an indicator of power output but may be addressed the same as and along with the longer ten second test isometric test), the coordination test 106, the proprioception test 108, the endurance test 110, and the strength capacity test 112 for any of the selected squat exercise movement (FIG. 15), side lying glute exercise movement (FIG. 16), latissimus dorsi exercise movement (FIG. 17), chest press exercise movement (FIG. 18), row exercise movement (FIG. 19), lift exercise movement (FIG. 20), and/or chop exercise movement (FIG. 21). There are a number of exercises that can be prescribed to address and improve each of these test results, examples of which include the following:

For Squat Movement (302):
Five Second Isometric Test (102, 602):
Maximum Force (114, 610):
Power squat sets
Single Leg Squats
Lunges
Step ups
Box Jumps
Split Jumps
Squat Thrust
One or more of the MRS games (Random Reactive, Isometric Gate, Controlled Route, Random Explosive, Controlled Position, and/or Random Deceleration)
MRS Isometric Game Series (Level 1, 2, 3, 4, and/or 5)
Side lunge Chops
Side lunge Lifts
Side lying MRS series single leg both for games and eccentric control
Rebounder weight balls both single leg and bilateral leg
Core board squats both single leg and bilateral legs
Average Force (116, 612):
Power squat sets
Single Leg Squats
Lunges
Step ups
Box Jumps
Split Jumps
Squat Thrust
One or more of the MRS games (Random Reactive, Isometric Gate, Controlled Route, Random Explosive, Controlled Position, and/or Random Deceleration)
MRS Isometric Game Series (Level 1, 2, 3, 4, and/or 5)
Side lunge Chops
Side lunge Lifts
Side lying MRS series single leg both for games and eccentric control
Rebounder weight balls both single leg and bilateral leg
Core board squats both single leg and bilateral legs
Ten Second Isometric Test (104, 702):
Maximum Force (118, 710):
Power squat sets
Single Leg Squats
Lunges
Step ups
Box Jumps
Split Jumps
Squat Thrust
One or more of the MRS games (Random Reactive, Isometric Gate, Controlled Route, Random Explosive, Controlled Position, and/or Random Deceleration)
MRS Isometric Game Series (Level 1, 2, 3, 4, and/or 5)
Side lunge Chops
Side lunge Lifts
Side lying MRS series single leg both for games and eccentric control
Rebounder weight balls both single leg and bilateral leg
Core board squats both single leg and bilateral legs
Average Force (120, 712):
Power squat sets
Single Leg Squats
Lunges
Step ups
Box Jumps
Split Jumps
Squat Thrust
One or more of the MRS games (Random Reactive, Isometric Gate, Controlled Route, Random Explosive, Controlled Position, and/or Random Deceleration)
MRS Isometric Game Series (Level 1, 2, 3, 4, and/or 5)
Side lunge Chops
Side lunge Lifts
Side lying MRS series single leg both for games and eccentric control
Rebounder weight balls both single leg and bilateral leg
Core board squats both single leg and bilateral legs
Coordination Test (106, 902):
Concentric (910): % of Correct Position (122, 912):
Toe Touch Squats
Dip Bridges
Single—Leg Bridge
Lunge Rotations
Reactive neuromuscular training lower extremity walk-aways
Pike peak planks
Plank holds
Eccentric (914): % of Correct Position (124, 916):
Toe Touch Squats
Dip Bridges
Single—Leg Bridge
Lunge Rotations Reactive neuromuscular training lower extremity walk-aways
Pike peak planks
Plank holds
Proprioception Test—Right (108, 1102):
Deviation from the Correct Position (126, 1104):
Toe Touch Squats
Dip Bridges
Single—Leg Bridge
Lunge Rotations
Reactive neuromuscular training lower extremity walk-aways
Pike peak planks
Plank holds
Proprioception Test—Left (108, 1202):
Deviation from the Correct Position (126, 1204):
Toe Touch Squats
Dip Bridges
Single—Leg Bridge
Lunge Rotations
Reactive neuromuscular training lower extremity walk-aways
Pike peak planks
Plank holds
Endurance Capacity Test (110, 1302):
Concentric (128, 1302):
Peak Force (130, 1312):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Maximal Speed (132, 1316):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Total Work (134, 1314):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Eccentric (136, 1318):
Peak force (138, 1320):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Maximal Speed (140, 1324):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Total Work (234, 1322):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Strength Capacity Test (112, 1402):
Concentric (144, 1410):
Peak Force (146, 1412):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Average Watts (148, 1414):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Eccentric (150, 1416):
Peak Force (146, 1412):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Average Watts (148, 1414):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
For Side Lying Glute Movement (304):
Five Second Isometric Test (102, 602):
Maximum Force (114, 610):
MRS series for the games and concentric & eccentric series both for single leg and both legs
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Average Force (116, 612):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Ten Second Isometric Test (104, 702):
Maximum Force (118, 710):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Average Force (120, 712):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Coordination Test (106, 902):
Concentric (910): % of Correct Position (122, 912):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Eccentric (914): % of Correct Position (124, 916):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Proprioception Test—Right (108, 1102):
Deviation from the Correct Position (126, 1104):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Proprioception Test—Left (108, 1202):
Deviation from the Correct Position (126, 1204):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Endurance Capacity Test (110, 1302):
Concentric (128, 1302):
Peak Force (130, 1312):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Maximal Speed (132, 1316):
One or more MRS games (Random Reactive, Isometric Gate, Controlled Route, Random Explosive, Controlled Position, and/or Random Deceleration)

MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Total Work (134, 1314):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Eccentric (136, 1318):
Peak Force (138, 1320):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Maximal Speed (140, 1324):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Total Work (242, 1322):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Strength Capacity Test (112, 1402):
Concentric (144, 1410):
Peak Force (146, 1412):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Average Watts 148, 1414):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Eccentric (150, 1416):
Peak Force (146, 1412):

One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
Average Watts 148, 1414):
One or more MRS games (Random Reactive, Isometric Gate, Controlled Route, Random Explosive, Controlled Position, and/or Random Deceleration)
MRS concentric & eccentric series (single leg and/or both legs)
Power squat sets
Single Leg Squats
Lunges
Step ups
Box Jumps
Split Jumps
Squat Thrust
Side lunge Chops
Side lunge Lifts
Side lying MRS series single leg both for games and eccentric control
Rebounder weight balls both single leg and bilateral leg
Core board squats both single leg and bilateral legs
For Latissimus Dorsi Movement (306):
Five Second Isometric Test (102, 602):
Maximum Force (114, 610):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (116, 612):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Ten Second Isometric Test (104, 702):
Maximum Force (118, 710):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (120, 712):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Coordination Test (106, 902):
Concentric (910): % of Correct Position (122, 912):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (914): % of Correct Position (124, 916):

One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Right (108, 1102):
Deviation from the Correct Position (126, 1104):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Left (108, 1202):
Deviation from the Correct Position (126, 1204):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Endurance Capacity Test (110, 1302):
Concentric (128, 1302):
Peak Force (130, 1312):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Maximal Speed (132, 1316):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (134, 1314):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (136, 1318):
Peak Force (138, 1320):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Maximal Speed (140, 1324):
One or more MRS games (Random Reactive, Isometric Gate, Controlled Route, Random Explosive, Controlled Position, and/or Random Deceleration)

MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (242, 1322):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Strength Capacity Test (112, 1402):
Concentric (144, 1410):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (150, 1416):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
For Chest Press Movement (308):
Five Second Isometric Test (102, 602):
Maximum Force (114, 610):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (116, 612):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)

Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Ten Second Isometric Test (104, 702):
Maximum Force (118, 710):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (120, 712):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Coordination Test (106, 902):
Concentric (910): % of Correct Position (122, 912):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (914): % of Correct Position (124, 916):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Right (108, 1102):
Deviation from the Correct Position (126, 1104):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Left (108, 1202):
Deviation from the Correct Position (126, 1204):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Endurance Capacity Test (110, 1302):
Concentric (128, 1302):
Peak Force (130, 1312):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)

Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Maximal Speed (132, 1316):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (134, 1314):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (136, 1318):
Peak Force (138, 1320):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Maximal Speed (140, 1324):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (234, 1322):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Strength Capacity Test (112, 1402):
Concentric (144, 1410):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel Single arm rowing and/or double arm rowing
Double kneel
Overhead pressing
Trunk rolling (single arm and/or double arm)
Chops (single arm and/or double arm)
Lifts (single arm and/or double arm)
Eccentric (150, 1416):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
For Row Movement (310):
Five Second Isometric Test (102, 602):
Maximum Force (114, 610):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (116, 612):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Ten Second Isometric Test (104, 702):
Maximum Force (118, 710):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (120, 712):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Coordination Test (106, 902):
Concentric (910): % of Correct Position (122, 912):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing Trunk rolling (single arm and/or double arm)
Chops (single arm and/or double arm)
Lifts (single arm and/or double arm)
Eccentric (914): % of Correct Position (124, 916):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Right (108, 1102):
Deviation from the Correct Position (126, 1104):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Left (108, 1202):
Deviation from the Correct Position (126, 1204):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Endurance Capacity Test (110, 1302):
Concentric (128, 1302):
Peak Force (130, 1312):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Maximal Speed (132, 1316):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (134, 1314):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (136, 1318):
Peak Force (138, 1320):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)

Maximal Speed (140, 1324):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (234, 1322):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Strength Capacity Test (112, 1402):
Concentric (144, 1410):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (150, 1416):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
For Lift Movement (312):
Five Second Isometric Test (102, 602:
Maximum Force (114, 610):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (116, 612):

One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Ten Second Isometric Test (104, 702):
Maximum Force (118, 710):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (120, 712):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Coordination Test (106, 902):
Concentric (910): % of Correct Position (122, 912):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (914): % of Correct Position (124, 916):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Right (108, 1102):
Deviation from the Correct Position (126, 1104):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Left (108, 1202):
Deviation from the Correct Position (126, 1204):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Endurance Capacity Test (110, 1302):
Concentric (128, 1302):
Peak Force (130, 1312):

One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Maximal Speed (132, 1316):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (134, 1314):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (136, 1318):
Peak Force (138, 1320):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Maximal Speed (140, 1324):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (234, 1322):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Strength Capacity Test (112, 1402):
Concentric (144, 1410):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)

One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (150, 1416):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
For Chop Movement (314):
Five Second Isometric Test (102, 602):
Maximum Force (114, 610):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (116, 612):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Ten Second Isometric Test (104, 702):
Maximum Force (118, 710):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Force (120, 712):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Coordination Test (106, 902):
Concentric (910): % of Correct Position (122, 912):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)

Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (914): % of Correct Position (124, 916):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Right (108, 1102):
Deviation from the Correct Position (126, 1104):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Proprioception Test—Left (108, 1202):
Deviation from the Correct Position (126, 1204):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Endurance Capacity Test (110, 1302):
Concentric (128, 1302):
Peak Force (130, 1312):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Maximal Speed (132, 1316):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (134, 1314):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (136, 1318):
Peak Force (138, 1320):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel Single arm rowing and/or double arm rowing
Double kneel
Overhead pressing
Trunk rolling (single arm and/or double arm)
Chops (single arm and/or double arm)
Lifts (single arm and/or double arm)
Maximal Speed (140, 1324):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Total Work (234, 1322):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Strength Capacity Test (112, 1402):
Concentric (144, 1410):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Eccentric (150, 1416):
Peak Force (146, 1412):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)
Average Watts 148, 1414):
One or more MRS games (Random Reactive, Isometric Gate, Controlled Route, Random Explosive, Controlled Position, and/or Random Deceleration)
MRS concentric and eccentric series (single arm and/or double arm)
One or more of Ball series (lats, rowing, and/or extension)
Rowing machine (single arm and/or double arm)
Lat pull downs (single arm and/or double arm)
Bench press
Core board press
½ kneel
Single arm rowing and/or double arm rowing
Double kneel
Overhead pressing
Trunk rolling (single arm and/or double arm)
Chops (single arm and/or double arm)
Lifts (single arm and/or double arm)

As also mentioned above, an important problem indicator for each of the tests is a side-to-side deficit over a deficit threshold, such as, for example, over five percent. A different percent deficit threshold can be chosen, but it is recommended that anything more than ten percent be an indication for the need to address and improve the muscle groups that have such a deficit. In one example implementation, a deficit of between five and ten percent may indicate an exercise regimen that is designed to lower the side-to-side deficit of an exercise function (isometric tests, coordination test, proprioception test, endurance capacity test, or strength capacity test) for a particular exercise movement (squat, side lying glute, latissimus dorsi, chest press, row, lift, or chop) to less than five percent by prescribing one or more of the exercises indicated above for improving that exercise function for that exercise movement on only the deficient side, i.e., unilateral exercise, until subsequent testing shows that the side-to-side deficit has been lowered to less than five percent. After the side-to-side deficit is reduced to less than five percent, then bilateral exercises, i.e., on both sides of the body, to improve the overall performance parameters in that function for that exercise movement on both sides of the body may be prescribed. If the deficit is more than ten percent, then it may be appropriate to prescribe unbalanced sets of both unilateral and bilateral exercises for that function, such as, for example, one set of unilateral exercise repetitions and two sets of unilateral exercise repetitions, to both reduce the side-to-side deficit and increase overall bilateral performance parameters for that function.

For example, testing for a bicycle rider, as mentioned above and indicated at 502 in FIG. 5, may include the five and ten second isometric tests 102, 104 (FIG. 1), the coordination test 106, the proprioception test 108, the endurance test 110, and the strength capacity test 112 for both the squat movement 302 and the latissimus dorsi movement 304. Each of those tests is then analyzed, and, if there is a side-to-side deficit of more than five percent in any one or more of the exercise functions (isometric test, coordination test, proprioception test, endurance capacity test, or strength capacity test) for either or both of those exercise movements (squat and latissimus dorsi), then unilateral and/or both unilateral and bilateral exercises for that function in that movement, as indicated above, may be prescribed as the beginning of an exercise regimen. For example, a side-to-side deficit of more than five percent in the coordination and proprioception functions for the squat movement would indicate prescription of unilateral and/or both bilateral and unilateral exercises including at least one or more of the following exercises to address the coordination and proprioception deficits in the squat movement, as indicated above:

Toe Touch Squats
Dip Bridges
Single—Leg Bridge
Lunge Rotations
Reactive neuromuscular training lower extremity walk-aways
Pike peak planks
Plank holds.

Then, as subsequent testing shows those side-to-side deficits to be reduced to less than five percent, then the regimen can progress to those exercises in bilateral sets to increase and/or maintain overall performance in those functions, and it can include any combination of the exercises indicated above to increase overall performance for the remaining functions in both of the squat and latissimus dorsi movements, as indicated above. For example, once all of the side-to-side deficits for all of the functions in both the squat and latissimus dorsi movements are below the desired threshold, such as five percent, then an exercise regimen may include any of the exercises listed above for squats and latissimus dorsi to increase bicycle riding performance or certain aspects of bicycle riding performance, e.g., hill climbing, speed, endurance, etc.

A similar testing and analyzing methodology can be followed for enhancing an athlete/subject's performance in other sports by testing the functions for the exercise movements that are important for such other sports, as indicated, for example, in FIG. 5, and then reducing any side-to-side deficits and increasing overall performance by prescribing exercise regimens that include exercises for the functions (isometric tests, coordination test, proprioception test, endurance capacity test, or strength capacity test) in the movements (squat, side lying glute, latissimus dorsi, chest press, row, lift, or chop) that need attention or improvement for a particular sport. As mentioned above, additional information and data, such as more conventional, less objective, test data, can also be used, if desired, and exercises to address any other deficiencies indicated by such other tests can also be added to the exercise regimen. For example, the FMS screening described by Gray Cook in his book mentioned above, although less objective than the testing with MRS equipment, may add useful information relating to limited mobility and/or stability, which can also be addressed by exercises or therapy recommended by Gray Cook or others to improve any limitations observed by such screening.

FIG. 30A is an example printout of lower extremity test results on a spreadsheet for showing example function test and re-test results as quantified by the MRS equipment for all of the isometric, coordination, proprioception, endurance capacity, and strength capacity functions tested in a squat movement of an athlete/subject.

FIG. 30B is a printout of upper extremity test results of a spreadsheet for showing example function test and re-test results as quantified by the MRS equipment for all of the isometric, coordination, proprioception, endurance capacity, and strength capacity functions tested in a squat movement of an athlete/subject.

FIG. 30C is a printout of Functional Movement Screen (FMS) observation test results according to the Gray Cook protocol and grading scale mentioned above. As also mentioned above, such FMS observations can, at the discretion of the trainer/coach and/or athlete/subject, also be considered in formulating an exercise regimen, such as if such FMS observations reveal mobility and/or stability problems.

FIG. 30D is a printout of a comparison of power outputs obtained from a strength capacity test for a squat movement, as described above, and average power measured by a bike exercise machine over five minutes and over twenty minutes. The MRS average power figures are the total average concentric and eccentric power figures from the strength test and then from the endurance test for squats, which indicate theoretical potentials of the athlete/subject for the bike output, and goals can be set for moving the bike performance closer to the theoretical potentials. The bottom portion of the printout shows an example exercise regimen for the athlete/subject to work toward achieving the goals indicated.

FIG. 30E is a printout of helpful information of a spreadsheet tool for the physical fitness regimen, which is based on work by Professor Vladimir Janda, M.D., D.Sc., and adds a list of bicycle activities or performance that can be diminished by various muscular weaknesses. FIG. 30F is a similar list for football.

FIG. 30G is a printout of the physical fitness regimen created for an athlete/subject of a spreadsheet tool for the physical fitness regimen.

FIG. 30H is a printout of a checklist for an athlete performing the physical fitness regimen of a spreadsheet tool for the physical fitness regimen.

FIG. 30I is a printout of the bike fit for a bicyclist of a spreadsheet tool for the physical fitness regimen.

FIG. 30J is a printout of the test results for a stationary bike test of a spreadsheet tool for the physical fitness regimen.

The various embodiments may utilize MRS rehabilitation equipment or non-MRS rehabilitation equipment. Other exercise equipment that may be designed to implement an embodiment of the invention may also be used to test an athlete/subject. In order for exercise equipment to work with an embodiment of the invention the exercise equipment will need to have comparable measurement capabilities to provide the objective, quantitative, and accurate neuromuscular and muscular performance data for both general neuromuscular and muscular performance and for a side-to-side deficit comparison of neuromuscular and muscular performance. Further embodiments of the invention may look beyond the listed test results and incorporate other results made available by the test equipment. Various embodiments may also test other exercise movements than those listed as necessary to address the physical fitness needs of the athlete/subject.

The foregoing description of the invention has been presented for purposes of illustration and description. It is not intended to be exhaustive or to limit the invention to the precise form disclosed, and other modifications and variations may be possible in light of the above teachings. The embodiments were chosen and described in order to best explain the principles of the invention and its practical application to thereby enable others skilled in the art to best utilize the invention in various embodiments and various modifications as are suited to the particular use contemplated. It is intended that the appended statements be construed to include other alternative embodiments of the invention except insofar as limited by the prior art. The words "comprise," "comprises," "comprising," "composed," "composes," "composing," "include," "including," and "includes" when used in this specification, including the claims, are intended to specify the presence of stated features, integers, components, or steps, but they do not preclude the presence or addition of one or more other features, integers, components, steps, or groups thereof.

The invention and several embodiments in which an exclusive property or privilege is claimed are defined as follows:

1. A method of testing and enhancing athletic performance of an athlete/subject, comprising:

Testing and measuring in a quantitative manner neuromuscular and muscular functions in a combination of both left and right sides in at least one upper body extremity exercise movement and both left and right sides in at least one lower body extremity movement;

Comparing the measurements of the neuromuscular and muscular functions for one side of the body with the measurements of the respective neuromuscular and muscular functions for the other side of the body to determine side-to-side deficits in the respective measured neuromuscular and muscular functions;

Performing an exercise regimen that includes unilateral exercises targeted to decrease any side-to-side deficit in the measured neuromuscular and muscular functions that exceed a predetermined deficit threshold; and When the side-to-side deficits are decreased to a level below the predetermined deficit threshold, performing bilateral exercises targeted to increase one or more of the measured neuromuscular and muscular functions in each of the selected exercise movements.

2. The method of claim 1 wherein the neuromuscular and muscular functions are selected from isometric, coordination, proprioception, endurance capacity, and strength capacity.

3. The method of claim 2, wherein the lower body extremity exercise movements are selected from squat and side lying glute, and wherein the upper body extremity exercise movements are selected from latissimus dorsi, chest press, row, lift, and chop.

4. The method of claim 3, wherein the exercises targeted to decrease side-to-side deficits and to increase the neuromuscular and muscular performance in the measured functions in the lower body extremity exercise movements are selected from at least power squats, single leg squats, lunges, step ups, box jumps, split jumps, squat thrust, one or more MRS games, MRS isometric game series, side lunge chops, side lunge lifts, side lying MRS series, rebounder weight balls, core squats, toe touch squats, dip bridges, single leg bridge, lunge rotations, reactive neuromuscular training lower extremity walkaways, pike peak planks, and plank holds; and Wherein the exercises targeted to decrease side-to-side deficits and to increase the neuromuscular and muscular performance in the measured functions in the upper body extremity exercise movements are selected from at least one or more MRS games, MRS concentric and eccentric series, one or more Ball series involving lats, rowing, and/or extension, rowing machine, lat pull downs, bench press, core board press, ½ kneel, double kneel, overhead pressing, trunk rolling, chops, and lifts.

* * * * *